US005253435A

United States Patent [19]

Auger et al.

[11] Patent Number: 5,253,435

[45] Date of Patent: Oct. 19, 1993

[54] PRESSURE-ADJUSTABLE SHOE BLADDER ASSEMBLY

[75] Inventors: Perry W. Auger; Daniel R. Potter, both of Tigard; Michael A. Aveni; Bruce J. Kilgore, both of Lake Oswego, all of Oreg.

[73] Assignee: Nike, Inc., Beaverton, Oreg.

[21] Appl. No.: 747,414

[22] Filed: Aug. 19, 1991

Related U.S. Application Data

[63] Continuation of Ser. No. 558,335, Jul. 27, 1990, which is a continuation-in-part of Ser. No. 521,011, May 9, 1990, abandoned, which is a continuation-in-part of Ser. No. 324,705, Mar. 17, 1989, abandoned, which is a continuation-in-part of Ser. No. 416,262, Oct. 3, 1989, abandoned, which is a continuation-in-part of Ser. No. 480,586, Feb. 15, 1990, abandoned.

[51] Int. Cl.[5] ..... A43B 7/06; A43B 7/14

[52] U.S. Cl. ..... 36/88; 36/114; 36/29; 36/71

[58] Field of Search ..... 36/115, 91, 29, 119, 36/120, 93, 88, 92, 114, 36, 3 B, 3 R, 43, 44, 26, 28, 71; 128/80 H; 417/472, 478, 413, 520, 306, 307; 24/589; 138/119, 121; 2/DIG. 3; 137/625.11, 625.12, 625.15, 625.19, 625.47

[56] References Cited

U.S. PATENT DOCUMENTS

| | | | |
|---|---|---|---|
| 435,452 | 9/1890 | Richards . | |
| 518,579 | 4/1994 | Annenberg . | |
| 643,181 | 2/1900 | Woodworth | 285/305 X |
| 746,338 | 12/1903 | Keen . | |
| 825,370 | 7/1906 | Zurbuck | 137/625.11 |
| 953,795 | 4/1910 | Nash | 137/625.11 |
| 1,313,924 | 8/1919 | Stewart . | |
| 1,364,226 | 1/1921 | Wherry . | |
| 1,375,585 | 4/1921 | Goodwin | 36/71 |
| 1,605,985 | 11/1926 | Rasmussen . | |
| 1,730,466 | 10/1929 | Mallott . | |
| 1,757,019 | 5/1930 | Mott . | |
| 1,954,122 | 4/1934 | Fiori | 36/71 |
| 1,976,656 | 10/1934 | Clark | 36/153 |
| 2,020,240 | 11/1935 | Cochran . | |
| 2,028,060 | 1/1936 | Gilbert . | |
| 2,086,389 | 7/1937 | Pearson | 36/71 |
| 2,103,108 | 12/1937 | Broecker et al. | 152/12 |
| 2,141,033 | 12/1938 | Crowley | 284/19 |
| 2,150,290 | 3/1939 | Mulvey . | |
| 2,177,116 | 10/1939 | Persichino . | |

(List continued on next page.)

FOREIGN PATENT DOCUMENTS 200963 12/1958 Austria .

(List continued on next page.)

OTHER PUBLICATIONS

Derwent Abstract G2328w/24.

"Pumping Up", Photo and discussion, Footwear News, Apr. 3, 1989, p. 1.

(List continued on next page.)

*Primary Examiner*—Steven N. Meyers

*Assistant Examiner*—Ted Kavanaugh

*Attorney, Agent, or Firm*—Banner, Birch, McKie & Beckett

[57] ABSTRACT

A bladder assembly for an athletic shoe and having at least first and second chambers. The chambers are independently and separately pressure adjustable by the user to conform to different concavity areas of his foot, such as the arch, ankle and metatarsal areas, to thereby enhance fit, comfort and athletic performance. Both chambers are inflatable by the same articulated on-board pump and deflatable by the same on-board depressible plunger. A dial on the lateral side of the upper allows the user to select which of the chambers is to be pressure adjusted, that is, which of the chambers is in pressure communication with the pump and the plunger. When the dial is in a neutral position, accidental inflation or deflation of either chamber is prevented.

20 Claims, 28 Drawing Sheets

U.S. PATENT DOCUMENTS

| | | | |
|---|---|---|---|
| 2,247,961 | 7/1941 | Mulvey . | |
| 2,255,932 | 9/1941 | Kraft et al. | 152/430 |
| 2,276,502 | 3/1942 | McCoy | 277/42 |
| 2,365,807 | 12/1944 | Dialynas | 36/8.5 |
| 2,439,545 | 4/1948 | Matlas . | |
| 2,531,763 | 11/1950 | Andre | 36/2.5 |
| 2,605,560 | 8/1952 | Gouabault . | |
| 2,638,690 | 5/1953 | Bullard | 36/71 |
| 2,663,020 | 12/1953 | Cushman . | |
| 2,686,006 | 8/1954 | Hasselquist . | |
| 2,699,915 | 1/1955 | Goepfrich | 251/121 |
| 2,715,231 | 8/1955 | Marston | 9/17 |
| 2,774,152 | 12/1956 | Alber | 36/71 |
| 2,830,585 | 4/1958 | Weiss | 128/166 |
| 2,840,109 | 6/1958 | Wadleigh | 137/625.11 |
| 2,942,359 | 6/1960 | Bushway et al. | 36/8.5 |
| 3,027,659 | 4/1962 | Gianola . | |
| 3,030,640 | 4/1962 | Gosman | 5/349 |
| 3,078,864 | 2/1963 | Schmid et al. | 137/223 |
| 3,079,941 | 3/1963 | Cruise et al. | 137/625.11 |
| 3,081 774 | 3/1963 | Lelyveld . | |
| 3,121,430 | 2/1964 | O'Reilly | 128/595 |
| 3,134,418 | 5/1964 | McConkie | 152/427 |
| 3,186,004 | 6/1965 | Carlini . | |
| 3,273,263 | 9/1966 | Klima . | |
| 3,312,213 | 4/1967 | Timm . | |
| 3,316,663 | 5/1967 | Neu . | |
| 3,372,495 | 3/1968 | Finn | 36/2.5 |
| 3,410,004 | 11/1968 | Finn . | |
| 3,469,576 | 9/1969 | Smith et al. | 128/595 |
| 3,508,572 | 4/1970 | Paffrath | 137/231 |
| 3,537,716 | 11/1970 | Norgiel | 280/11.3 |
| 3,659,361 | 5/1972 | White, Sr. | 36/2.5 |
| 3,664,043 | 5/1972 | Polumbus, Jr. | 36/71 |
| 3,685,176 | 8/1972 | Rudy | 36/71 |
| 3,716,930 | 2/1973 | Brahm . | |
| 3,744,159 | 7/1973 | Nishimura | 36/2.5 |
| 3,750,310 | 8/1973 | Messner et al. . | |
| 3,758,964 | 9/1973 | Nishimura | 36/205 |
| 3,760,056 | 9/1973 | Rudy | 264/299 |
| 3,854,228 | 12/1974 | Conroy | 36/71 |
| 3,872,511 | 3/1975 | Nichols . | |
| 3,876,746 | 4/1975 | Hanson . | |
| 3,925,916 | 12/1975 | Garbuio | 36/71 |
| 4,035,846 | 7/1977 | Jencks . | |
| 4,067,063 | 1/1978 | Ettinger . | |
| 4,068,323 | 1/1978 | Gwon . | |
| 4,126,323 | 11/1978 | Scherz | 280/11.12 |
| 4,178,013 | 12/1979 | Bataille . | |
| 4,183,155 | 1/1980 | Payne . | |
| 4,232,459 | 11/1980 | Vaccari . | |
| 4,236,725 | 12/1980 | Bataille . | |
| 4,266,298 | 5/1981 | Graziano . | |
| 4,287,613 | 9/1981 | Schulz . | |

(List continued on next page.)

FOREIGN PATENT DOCUMENTS

| | | | |
|---|---|---|---|
| 515639 | 12/1952 | Belgium . | |
| 951117 | 7/1974 | Canada . | |
| 951118 | 7/1974 | Canada . | |
| 0040189 | 11/1981 | European Pat. Off. | 36/117 |
| 152401 | 8/1985 | European Pat. Off. . | |
| 0155495 | 9/1985 | European Pat. Off. | 36/117 |
| 0221808 | 5/1987 | European Pat. Off. | 36/117 |
| 2164921 | 10/1972 | Fed. Rep. of Germany . | |
| 2215098 | 5/1973 | Fed. Rep. of Germany . | |
| 2162619 | 6/1973 | Fed. Rep. of Germany . | |
| 2308547 | 12/1973 | Fed. Rep. of Germany . | |
| 2365329 | 3/1974 | Fed. Rep. of Germany . | |
| 2456612 | 6/1975 | Fed. Rep. of Germany . | |
| 3200139 | 5/1982 | Fed. Rep. of Germany . | |
| 3326085 | 7/1983 | Fed. Rep. of Germany . | |
| 3427644A | 1/1986 | Fed. Rep. of Germany . | |
| 3600437 | 7/1987 | Fed. Rep. of Germany | 36/117 |
| 1406610 | 11/1965 | France . | |
| 2252820 | 6/1976 | France . | |
| 2356384 | 1/1978 | France . | |
| 2496423 | 6/1982 | France | 36/117 |
| 87/03789 | 7/1987 | PCT Int'l Appl. . | |
| 90/04323 | 3/1990 | PCT Int'l Appl. . | |
| 90/09115 | 9/1990 | PCT Int'l Appl. . | |
| 0011170 | of 1887 | United Kingdom . | |
| 26637 | of 1887 | United Kingdom . | |
| 866934 | 5/1961 | United Kingdom . | |
| 939529 | 10/1963 | United Kingdom . | |
| 2111821A | 7/1983 | United Kingdom . | |
| 8910074 | 11/1989 | World Int. Prop. O. | 36/29 |

OTHER PUBLICATIONS

"New Generation", Photo and discussion, Footwear News, Sep. 11, 1989, p. 26.

"Primed To Deliver The Pump", Footwear News, Oct. 2, 1989.

"Nike Takes To The Scale To Win The Weight Test", Footwear News, Jan. 22, 1990.

"Reebok Readies High-Tech Double Pump", Footwear News, Nov. 4, 1991, p. 26.

"Reebok Get Suspension Placed On Spalding Gloves", Footwear News, Jul. 22, 1991, p. 68.

"Reebok Actively Seeking To License Technology", Footwear News, Jul. 22, 1991, p. 66.

L. A. Gear Regulator Ad, Footwear News, Sep. 24, 1990.

L. A. Gear Regulator Ad, Footwear News, Oct. 1, 1990.

(List continued on next page.)

U.S. PATENT DOCUMENTS

| | | | |
|---|---|---|---|
| 4,353,902 | 11/1982 | Cole et al. . | |
| 4,361,969 | 12/1982 | Vermonet | 36/88 |
| 4,370,754 | 2/1983 | Donzis . | |
| 4,385,456 | 5/1983 | Livernois et al. | 36/115 |
| 4,423,735 | 1/1984 | Comparetto . | |
| 4,446,634 | 5/1984 | Johnson et al. . | |
| 4,458,429 | 7/1984 | Schmid . | |
| 4,481,970 | 11/1984 | Reid | 137/223.5 |
| 4,538,367 | 9/1985 | Adams | 36/50 |
| 4,539,764 | 9/1985 | Pradier | 36/121 |
| 4,590,691 | 5/1986 | Oliviero | 36/119 |
| 4,593,690 | 6/1986 | Sheridan et al. | 138/119 X |
| 4,631,843 | 12/1986 | Annovi . | |
| 4,662,087 | 5/1987 | Beuch | 36/88 |
| 4,670,995 | 6/1987 | Huang . | |
| 4,702,022 | 10/1987 | Porcher | 36/119 |
| 4,712,316 | 12/1987 | Baggio . | |
| 4,719,670 | 1/1988 | Kurt | 36/119 X |
| 4,724,627 | 2/1988 | Sisco . | |
| 4,730,403 | 3/1988 | Walkhoff . | |
| 4,730,610 | 3/1988 | Graebe . | |
| 4,739,813 | 4/1988 | Pagani | 152/427 |
| 4,744,157 | 5/1988 | Dubner | 36/88 |
| 4,756,306 | 7/1988 | Durlee . | |
| 4,763,426 | 8/1988 | Polus et al. . | |
| 4,776,110 | 10/1988 | Shiang . | |
| 4,781,189 | 11/1988 | Vijil-Rosales . | |
| 4,819,685 | 4/1989 | Pagani | 137/223 |
| 4,832,482 | 4/1989 | Lakic . | |
| 4,836,235 | 6/1989 | Pagani | 137/223 |
| 4,852,564 | 8/1989 | Sheridan et al. | 138/121 X |
| 4,893,367 | 1/1990 | Heimreid et al. | 5/431 |
| 4,912,861 | 4/1990 | Huang . | |
| 4,916,836 | 4/1990 | Baggio et al. | 36/119 |
| 4,921,147 | 3/1990 | Poirier | 138/121 X |
| 4,927,191 | 5/1990 | Mikol | 138/121 X |
| 4,936,029 | 6/1990 | Rudy . | |
| 4,949,479 | 8/1990 | Ottieri . | |
| 4,962,762 | 10/1990 | Beekil . | |
| 4,995,149 | 9/1990 | Ottieri . | |
| 4,995,173 | 2/1991 | Spier | 36/114 X |
| 4,999,932 | 2/1991 | Grim . | |
| 5,015,515 | 5/1991 | Paulin | 138/121 X |

OTHER PUBLICATIONS

"Has Sneaker Madness Gone Too Far?", Newsweek, Dec. 18, 1989.

"Now, Running On Empty", Newsweek, Dec. 3, 1990.

Robinson et al., "Systematic Ankle Stabilization and the Effect on Performance", Medicine and Science In Sports and Exercise, vol. 18, No. 6, pp. 625–628, 1986.

"It's Back To The Future", Sportstyle, Mar. 6, 1989.

"Air Pressure From Nike" Ad, USA Today, Oct. 24, 1989.

"Pumped-Up Reebok Runs Fast Break With New Shoe", Wall Street Journal, Dec. 20, 1989.

"From Air To Pump To Puma's Disc System, Sneaker Gimmicks Bound To New Heights", The Wall Street Journal, Oct. 31, 1991, p. B1.

PRESSURE-ADJUSTABLE SHOE BLADDER ASSEMBLY

CROSS-REFERENCE TO RELATED APPLICATIONS

This is a continuation of Ser. No. 07/558,335 which is filed Jul. 27, 1990 a continuation-in-part (CIP) of (1) copending application Ser. No. 07/521,011 ('011) filed May 9, 1990 now abandoned, which in turn is a CIP of copending applications (a) Ser. No. 07/324,705 ('705), filed Mar. 17, 1989, now abandoned, (b) Ser. No. 07/416,262 ('262) now abandoned, filed Oct. 3, 1989, which is a CIP of the '705 application, and (c) Ser. No. 07/480,586 ('586) now abandoned, filed Feb. 15, 1990, which in turn is a CIP of the '705 and '262 applications; (2) the '262 application; and (3) the '586 application. The contents of all of these applications and any patents or other publications mentioned anywhere in this disclosure are hereby incorporated by reference in their entireties.

FIELD OF THE INVENTION

The present invention relates to athletic shoes and, more particularly, to athletic shoes wherein the upper extends around the ankle bones, such as in high-top basketball shoes or high-top skates. The invention is also directed to systems which customize the fit of the shoe to the individual foot, such as the shoe upper around the ankle bones by means of pressurized collars or the individualized fit of the shoe to the arch or metatarsal areas of the foot. It is further concerned with pump assemblies for controllably and incrementally increasing the pressure in shoe bladders, and the construction of these pump assemblies.

BACKGROUND OF THE INVENTION

Current athletic shoes are a combination of many elements which have specific functions, all of which must work together for the support and protection of the foot during an athletic event. The shoes are designed to provide a unique and specific combination of traction, support and protection to enhance athletic performance. Shoes are designed for specific sports and also to meet the specific characteristics of the user. For example, athletic shoes are designed differently for heavier persons than for lighter persons, differently for wide feet than for narrow feet, differently for high arches than for lower arches, and so forth. Some shoes are designed to correct physical problems, such as overpronation, while others include devices, such an ankle supports, to prevent physical problems from developing.

Athletic shoes are divided into two general parts—an upper and a sole. The sole is attached to the bottom of the upper and provides traction, protection and a durable wear surface. The upper is designed to snugly and comfortably enclose the foot. In a running or jogging shoe, the upper typically terminates below the ankle bones and will have several layers including a weather and wear resistant outer layer of leather or synthetic material, such as nylon, and a soft padded inner liner for foot comfort. In athletic shoes designed for sports which require the athlete to make sudden and rapid lateral movements, such as in basketball, football, tennis or ice hockey, the upper frequently extends up to or above the ankle bones (the medial and lateral malleoli).

Such shoes are referred to as three-quarter height or high top shoes.

Attaining a proper fit around the ankle bones in three-quarter height and high-top athletic shoes has been a problem because the uneven contour around the ankle bones varies from person to person. The typical prior art technique for fitting the upper around the ankle bones has been to line the ankle portion of the upper with a relatively soft foam material. However, since no two persons have precisely the same ankle bone configuration, the foam material only approximates a customized fit.

The use of adjustable air-inflated bladders in the ankle portion of an upper is also found in the prior art. The most frequent use of such bladders is found in ski boots wherein the upper is relatively inflexible and the air bladders are designed to embrace the ankle and lower leg and provide a restraining force against the foot. Such air bladders typically form rigid vertical columns along the medial and lateral sides of the foot and leg, thereby restricting movement of the foot. While such restriction of motion is desirable in a ski boot, it interferes with required foot motion in athletic shoes designed for athletic activities such as basketball, football and tennis. West German Patents 2,365,329 and 2,308,547 disclose examples of such air bladders used in ski boots. As seen in FIGS. 4 and 5 of these patents, a separate tongue bladder and ankle bladder are provided, with the ankle bladder having cut out areas avoiding the malleoli and achilles tendon. However, as is typical in ankle bladders used in prior art ski boots, the ankle bladder forms relatively rigid vertical columns.

U.S. Pat. No. 3,758,964 relates particularly to ski boots and shows a bag member enclosed therein. Two chambers A and B are illustrated in FIG. 16 of the '964 patent. Chamber B forms an uninterrupted column of pressurized gas from the top to the bottom on both the medial and lateral sides; it also completely covers the malleoli. Chamber A, while not extending the entire vertical height, does form a restrictive column adjacent the malleoli. A different configuration for chambers A and B is depicted in FIG. 17 of the '964 patent. Chamber B therein forms a less substantial vertical column, but one would still form along the outer perimeter, anterior of the malleoli. Chamber A also forms a vertical column posterior to the malleoli. FIG. 18 of this patent shows two small chambers B and a large chamber A. While chambers B cover the malleoli thereby restricting movement, chamber A forms vertical columns posterior to the malleoli. These vertical columns are formed near the malleoli and thereby have a stiffening effect which restricts plantar and dorsi flexion of the foot. Although these restrictive vertical columns in covering of the malleoli are preferred for activities such as skiing where the foot must be secured in the boot, they actually reduce the athlete's performance in sports such as basketball, football, soccer, tennis and running.

Examples of other shoes having bladders or similar arrangements include those disclosed in U.S. Pat. Nos. 1,313,924, 2,086,389, 2,365,807, 3,121,430, 3,469,576, 3,685,176, 3,854,228, 4,232,459, 4,361,969 and 4,662,087 and in French 1.406.610 patent. See also U.K. application 2.111.821.A, Some of these designs include bladder placement which actually interferes with the fit of the foot in the shoe, some are not volume or pressure adjustable to provide a customized fit, some interfere with cushioning components of the shoe, some restrict the movement of the foot and some interfere with the pronation/supination action of the foot. None of them meets today's rigorous athletic standards, and none of them is especially well-suited for use in high top ice skates, basketball or tennis shoes.

An example of a recent inflatable shoe is THE PUMP basketball shoe available from Reebok. This shoe has a round molded rubber bulb pump on the tongue of the shoe and having an opening at one end and a one-way valve at the other end. A piece of tubing is stuck into that opening at one tubing end and the other tubing end is stuck into a flange attached to the shoe bag, which originally used reticulated foam therein, and held therein by adhesive. A duck-bill type of valve in the flange allows air to flow only from the bulb pump to the bag and not the other way. The deflation valve is a piece of tubing with one end welded to and sticking out of the bladder. The other tubing end is hooked to a molded plastic housing, and a metal-pin Schroeder tire deflation valve is secured in the housing.

A number of problems with this bladder-pump assembly have been experienced. Adhesives used to secure the pump and bag components together are often not reliable and are difficult to work with. For example, the adhesives have shelf-lives, are affected by moisture, require clean application surf aces and can be contaminated when being mixed. If the pump is subjected to considerable flexing during athletic activity, the tube tends to pop out of it. To fix it requires that the shoe be torn open, and thus as a practical matter it is not repairable by the consumer. When excessive strain is applied, failure can also occur where the pump tubing enters the flange. Different size bladders for different shoes disadvantageously require different lengths of this rigid tubing. The deflation valve has numerous moving and connection parts and thus is unnecessarily likely to fail, difficult to assemble and bulky.

SUMMARY OF THE INVENTION

The present invention is directed to an athletic shoe comprised of a sole and an upper attached to the sole. The upper includes an ankle portion extending around at least a portion of the area of the medial and lateral malleoli. An inflatable bladder is attached within the ankle portion of the upper and has a medial section, a lateral section and an inlet mechanism for supplying pressurized gas to the interior of the bladder. A mechanism is incorporated into both the medial and lateral sections of the bladder for preventing the formation of restrictive vertical columns of pressurized gas in the medial and lateral sections.

In one embodiment, the inflatable bladder is formed of two separate sheets or layers of elastomeric film connected to one another around the perimeter of the bladder. Polyurethane can be used, and it is also within the scope of the invention to make the bladder by blow molding. The medial and lateral sections of the bladder are both divided into upper and lower chambers by connection lines between the sheets of elastomeric film. The connection lines form the prevention mechanism and extend generally horizontally in each of the medial and lateral sections substantially along the entire horizontal extent of the lateral and medial sections in the area of the lateral and medial malleoli, respectively.

The medial and lateral sections of the inflatable bladder each have edges defining a cut out area. Each cut out area surrounds the area of a respective malleoli so that the medial and lateral malleoli are not covered by the inflatable bladder.

An athletic shoe incorporating the inflatable bladder of the present invention takes advantage of the adjustability of an inflatable bladder which can adapt itself to various ankle and leg configurations when pressurized, thereby providing a customized fit around any ankle. However, this advantage is obtained while alleviating the disadvantage of the rigidity found in prior art air bladders which formed relatively stiff vertical columns on either side of the ankle. Thus, the athletic shoe of the present invention can be comfortably worn in athletic activities, such as basketball, football and tennis, which require a high degree of flexibility for plantar and dorsi flexion.

Another embodiment of the present invention is particularly directed to high-top ice skates. The upper thereof includes an ankle portion extending around at least a portion of the area of the medial and lateral malleoli. One or more malleoli chambers are positioned in this shoe to fill in the areas below the malleoli. One or more arch chambers are positioned at the arch area in the shoe. Upper heel chambers fill in the areas behind and slightly above the malleoli. Each of these chambers is pressure adjustable through a valve stem accessible from outside the shoe. When inflated these chambers contour to the concavities of the foot adjacent the malleoli and at the arch without restricting the plantar or dorsi flexion of the foot.

A further embodiment of the present invention is especially useful in today's basketball shoes. The ankle bladder in the shoe is pressure adjustable by the user to provide an individualized fit and comfort. Air is pumped into the bladder by a lightweight pump assembly built into the lateral collar of the shoe. Since adhesives are not required in the assembly of and the attachment of the pump assembly to the bladder, failure is unlikely. The tubing communicating the squeezable bulb pump with the bladder connector comprises a flexible bellows integrally molded at one end with the bulb pump and affixed by mechanical securement means at the other end to the connector or weld flange. This means includes a barbed interference fit supplemented with a bail or wire retainer, and thus the bulb pump is a permanent part of the shoe. The flange of the connector is formed of a material compatible with the urethane bladder so that it can be RF welded in place thereon. The bellows being flexible and articulatable allow one size of built-in pump assembly to be used on shoe sizes eight to fourteen. A simple, reliable release valve RF welded to the bladder, spaced from the bladder connector and easily accessible at the outside back of the shoe allows the user to release pressure in the bladder, as needed.

When more than one bladder is used in a shoe, for example one for the arch and another for the ankle area, it is desirable to be able to separately inflate and deflate them to different pressures to accommodate different feet and fits. Thus, a still further embodiment provides a novel valve mechanism. A dial of this mechanism, conveniently positioned on the lateral side of the upper, can be turned to any of three positions. When in the first position, the depressible plunger of the valve mechanism and the articulatable on-board pump can be operated to adjust the pressure only in one chamber. When in the second position, the plunger and pump can be operated to adjust the pressure only in the other chamber. And when in the third position, neither the pump nor the plunger can be operated which prevents any unintentional pressure change in either of the chambers. The chambers, the valve mechanism and the pump are assembled as an interconnected assembly. The plunger barrel of the valve mechanism is snap fit into a ring-tee member unit affixed to the upper. The interconnected assembly is thereby automatically and properly positioned and oriented in the shoe.

Various advantages and features of novelty which characterize the invention are pointed out with particularity in the claims annexed hereto and forming a part hereof. However, for a better understanding of the invention, its advantages and objects obtained by its use, reference should be had to the drawings which form a further part hereof and to the accompanying descriptive matter in which there is illustrated and described a number of preferred embodiments of the invention.

DETAILED DESCRIPTION OF PREFERRED EMBODIMENTS OF THE INVENTION

Figure 1:
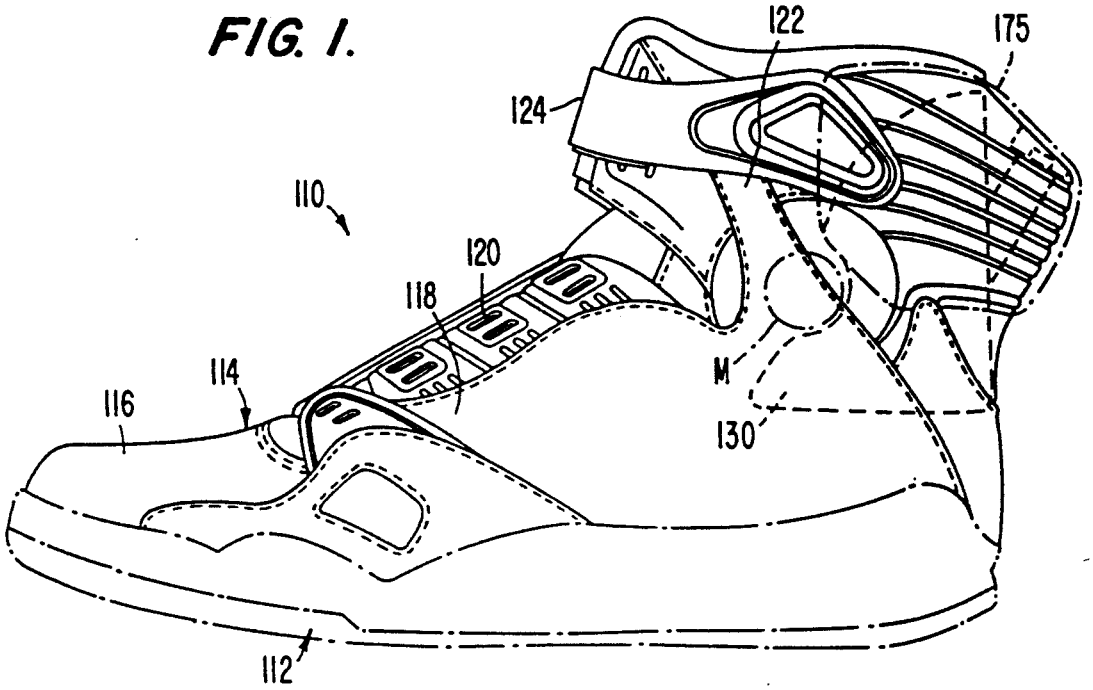
FIG. 1 is a lateral side view of an athletic shoe of the present invention illustrating the inflatable bladder thereof in dashed line.
Figure 2:
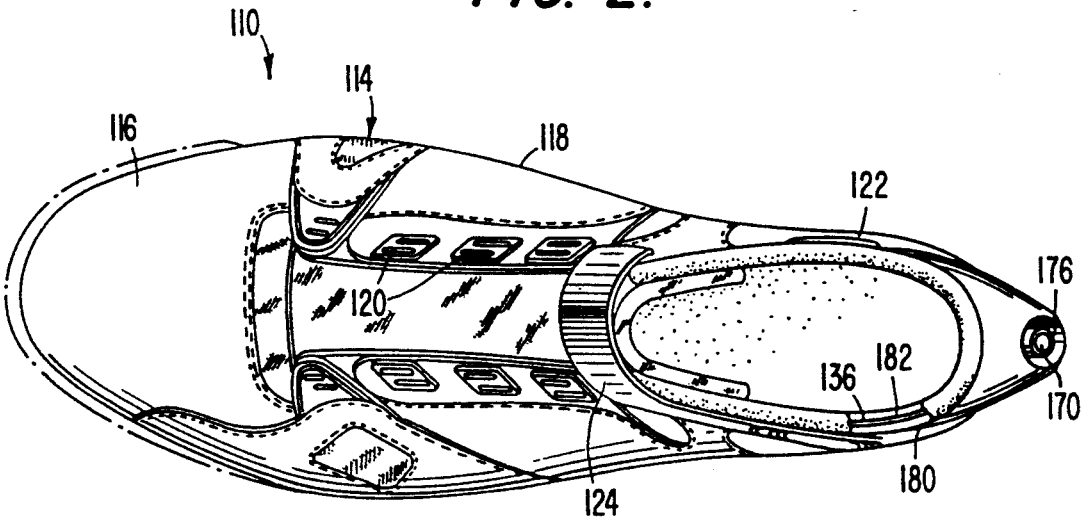
FIG. 2 is a top plan view of the athletic shoe, partially broken away, illustrating the inflatable bladder between an outer layer and inner liner of the upper.

Referring to the drawings, wherein like numerals indicate like elements, there is illustrated in FIGS. 1 and 2 an athletic shoe 110 in accordance with the present invention. Shoe 110 includes a sole 112 attached in a conventional manner, for example, by an adhesive, to an upper 114. Shoe 110 is preferably a high top type of athletic shoe wherein upper 114 extends around and above the medial and lateral malleoli, indicated as M in FIGS. 1 and 4. Sole 112 is a cup-type sole wherein a portion of the sole extends around the sides of upper 114. Upper 114 includes a toe portion 116, extending around the area of the toes, an instep portion 118 extending around the instep portion of the foot and including lacing eyelets 120 and an ankle portion 122 extending around the ankle and lower leg. Ankle portion 122 also includes lacing eyelets 120 and a tightening strap 124.

Figure 3:
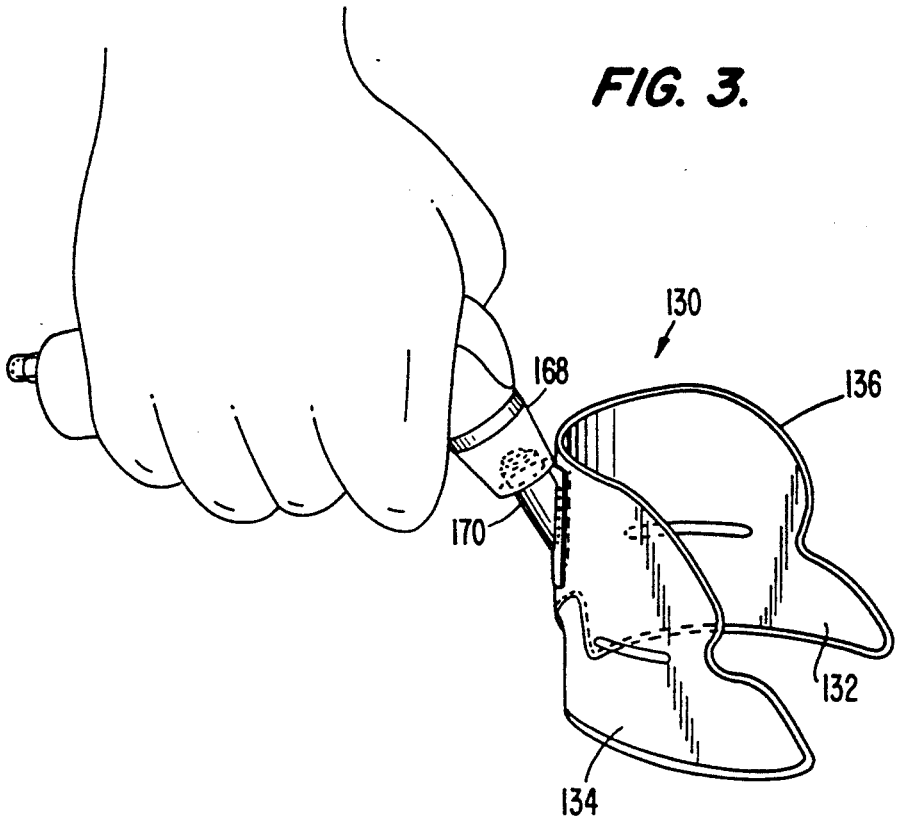
FIG. 3 is a perspective view of the inflatable bladder connected to a hand pump.
Figure 4:
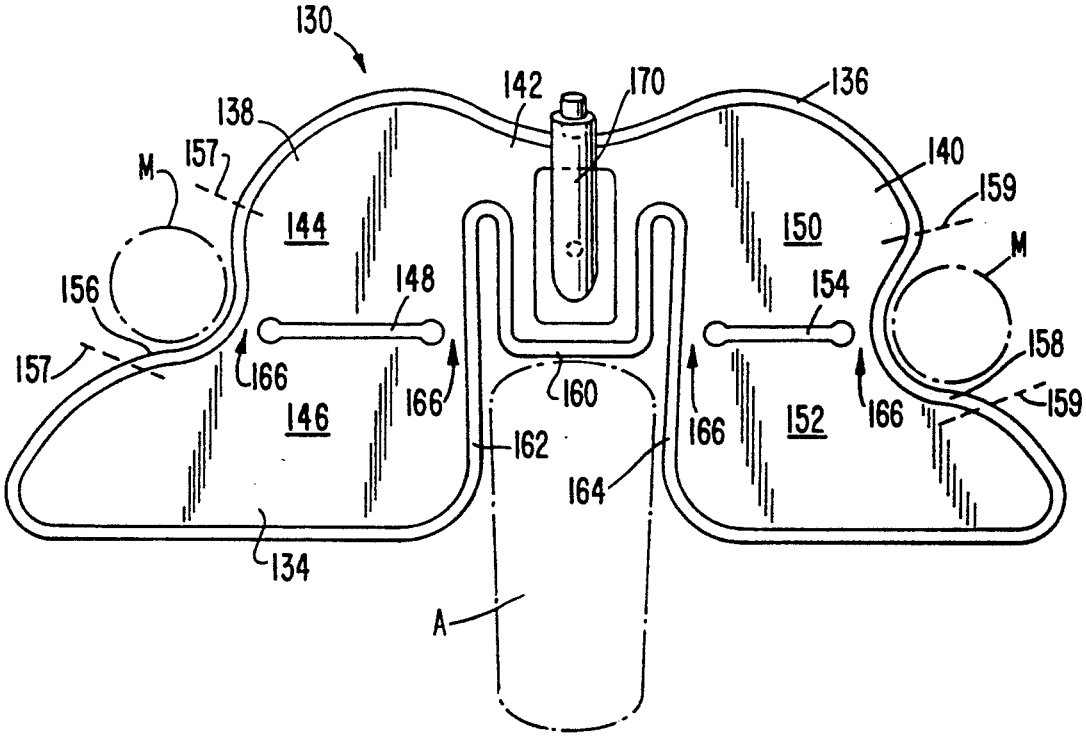
FIG. 4 is a plan view of the inflatable bladder extended flat, with portions of a foot and leg anatomy shown diagrammatically in phantom line.

An inflatable bladder 130 is attached to ankle portion 122 of upper 114, and details thereof are best seen in FIGS. 3 and 4. Bladder 130 is formed of two separate sheets or layers of elastomeric film, an inside layer 132 and an outside layer 134, which are sealed together along their perimeter edges 136. Bladder 130 has a medial section 138, a lateral section 140 and a small rear section 142 in fluid communication between the medial and lateral sections. Medial section 138 is divided into an upper portion 144 and a lower portion 146 by a divider formed of a weld line 148 connecting inner and outer layers 132 and 134. Lateral section 140 is similarly divided into an upper portion 150 and a lower portion 152 by a divider formed of a weld line 154 connecting inner and outer layers 132 and 134.

When bladder 130 is incorporated into ankle portion 122, weld line 148 is in vertical alignment with the area of the medial malleoli M as shown diagrammatically in FIG. 4, and weld line 154 is vertically aligned with the area of lateral malleoli M, also as illustrated in FIG. 4. Similarly, as illustrated diagrammatically in FIG. 4, perimeter 136 on the medial side defines a cut out area 156, approximately between dash lines 157, which surrounds the area of the medial malleoli so that the bladder does not cover the medial malleoli. On the lateral side, perimeter 136 also defines a lateral cut out area 158, approximately between dashed lines 159, which surrounds the area of the lateral malleoli so that bladder 130 does not cover or extend over the lateral malleoli.

A lowermost edge 160 of rear section 142 is located above the achilles tendon area, indicated diagrammatically as A in FIG. 4, and the medial and lateral sections 138, 140 have rearward edges 162 and 164 disposed to the sides of achilles tendon area A so that no portion of inflatable bladder 130 overlies the achilles tendon.

Weld lines 148 and 154 function as dividers in the medial and lateral sections and perform the critical function of preventing the formation of vertical columns of pressurized gas on the medial and lateral sides. Such pressurized vertical columns would unduly restrict the motion of the foot and ankle. To perform this function, medial weld line 148 extends horizontally along substantially the entire extent of medial section 138 in the area of medial malleoli M so that only small areas of fluid communication 166 remain between upper and lower portions 144 and 146. Similarly, weld line 154 extends horizontally along substantially the entire width of lateral section 140 in the area of the lateral malleoli so that only small fluid communication areas 166 exist between upper and lower portions 150 and 152. These small areas 166 are insufficient to allow the formation of rigid vertical columns of pressurized air.

As seen in FIG. 3, bladder 130 is bent in a generally U-shaped configuration for incorporation into ankle portion 122. In order to inflate bladder 130, a pump, such as hand pump 168, is connected to a valve 170 extending from rear section 142 and ambient air is pumped through the valve. Inflatable bladder 130 is incorporated into ankle portion 122 between an outer layer 180 of the upper and an inner liner 182 of the upper. A portion of outer layer 180 of the upper, in the area indicated generally by dot and dash line 175, can be formed into a pre-shaped shroud from a relatively high density foam material and may include an aperture 176 through which valve 170 extends and can be accessed by hand pump 168. Since the shroud is formed of a high density foam material, for example 0.2–0.4 gm/cm$^3$, it takes on a relatively fixed, but flexible configuration. When inflated by hand pump 168, medial and lateral sections 138 and 140 expand to fill in the areas surrounding the medial and lateral malleoli to provide a comfortable fit for the high-top portion of the upper. However, since weld lines 148 and 154 prevent the formation of pressurized vertical columns, plantar and dorsi flexion are not thereby restricted.

Figure 5:
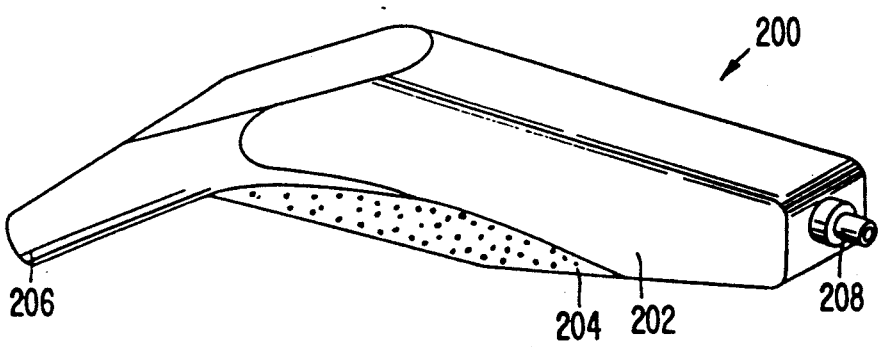
FIG. 5 is a perspective view illustrating in isolation a hand pump of the present invention.

A preferred hand pump 168 of the present invention is illustrated in isolation in FIG. 5 generally at 200. It is seen therein to include a pump body 202 of a flexible plastic material which can be easily grasped and controllably compressed by a hand squeeze and when the pressure of the hand squeeze is released returns to its normal expanded position. The body 202 further includes a bumpy and raised lower surface 204 providing a friction surface to be easily held in the user's hand. When the pump body 202 is compressed, air in the body is expelled or forced out of the outlet end 206. When it is subsequently released, the air is sucked in through the opposite inlet end 208.

Both inlet and outlet ends 208, 206 include internal sliding rods which slide within their nozzle housings between open and closed positions relative to their openings as needed for the pumping action. A sample valve housing for the outlet end 206 and in which the outlet rod slides is shown in isolation in FIGS. 11–13 generally at 210. When released, the outlet plug or rod, which is shown at 211 in FIG. 12, is then sucked or drawn inward to a position spaced from the prongs 212 closing the opening. The prongs or cross-bars 212 provide an abutment surface for depressing the valve assembly shown generally at 214 to open it so that air can be injected into the bladder 216. Similarly, the sliding rod of the inlet end 208 slides to an open position when the pump body 202 is released to allow air to be sucked in through the opening. At that time the outlet end 206 is in a closed position by the outlet rod. When the body 202 is compressed, the sliding inlet rod is forced outwardly to close the inlet end 208 so that all of the expelled air pressure is expelled through the outlet end 206.

Figure 6:
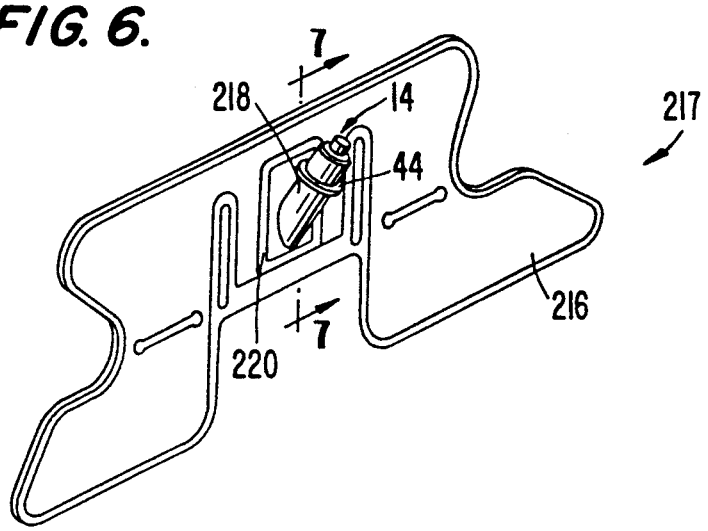
FIG. 6 is a perspective view illustrating in isolation an alternative bladder and valve assembly of the present invention.
Figure 7:
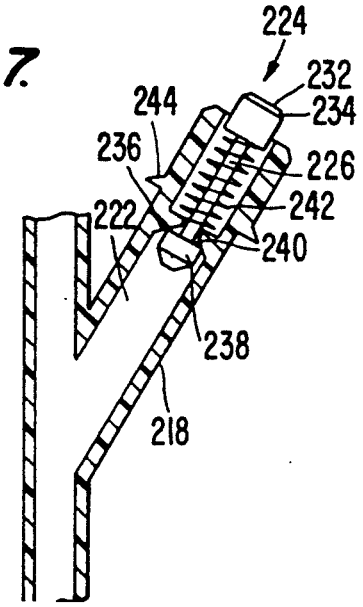
FIG. 7 is a cross-sectional view taken along line 7—7 of FIG. 6.
Figure 8:
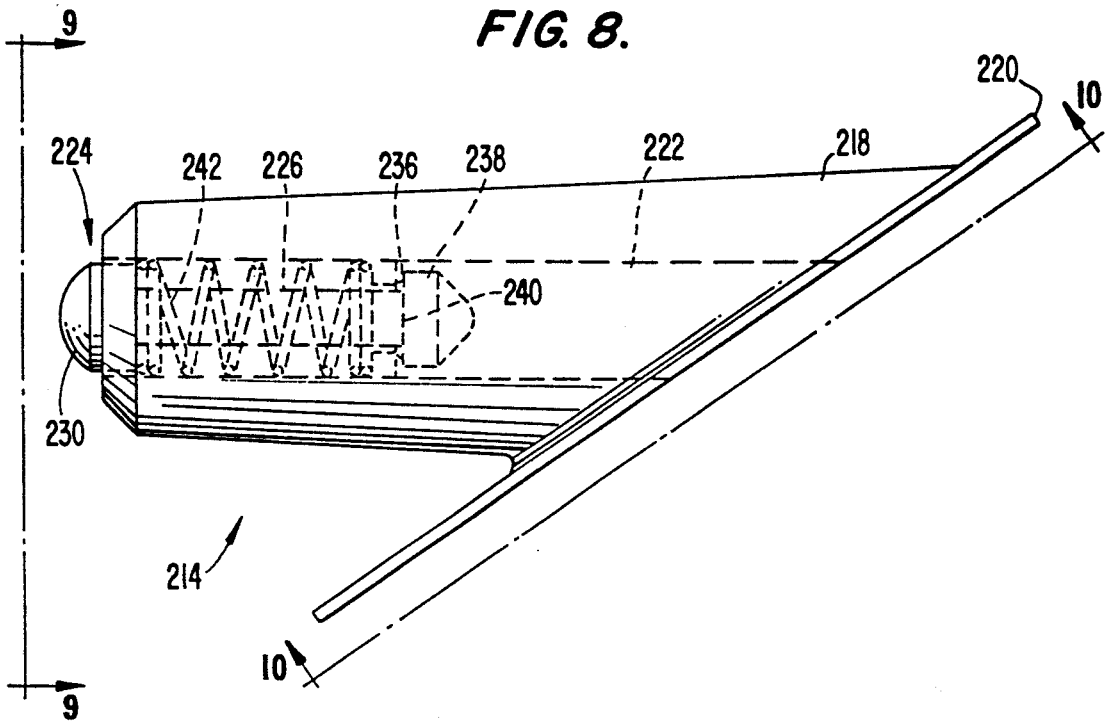
FIG. 8 is a side elevational view of an alternative valve assembly which can be used, for example, on the bladders of FIGS. 3, 4 or 6.
Figure 9:
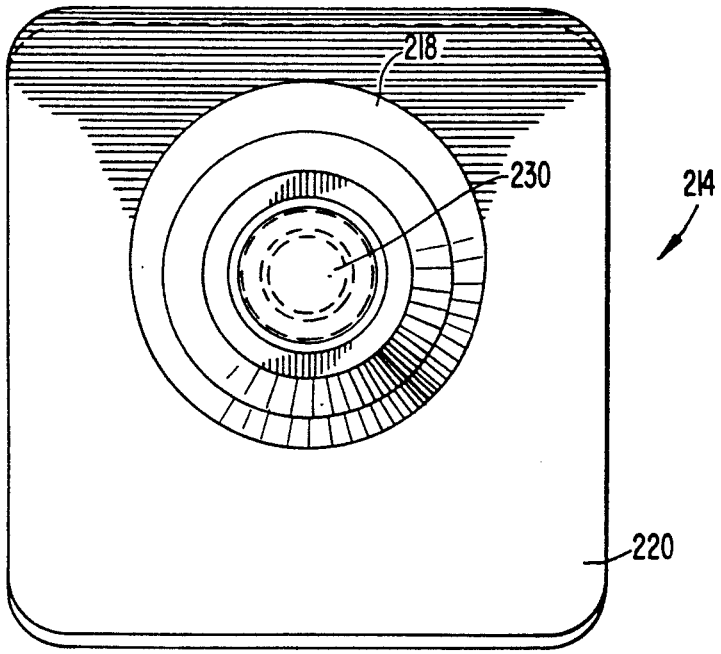
FIG. 9 is a view taken on line 9—9 of FIG. 8.
Figure 10:
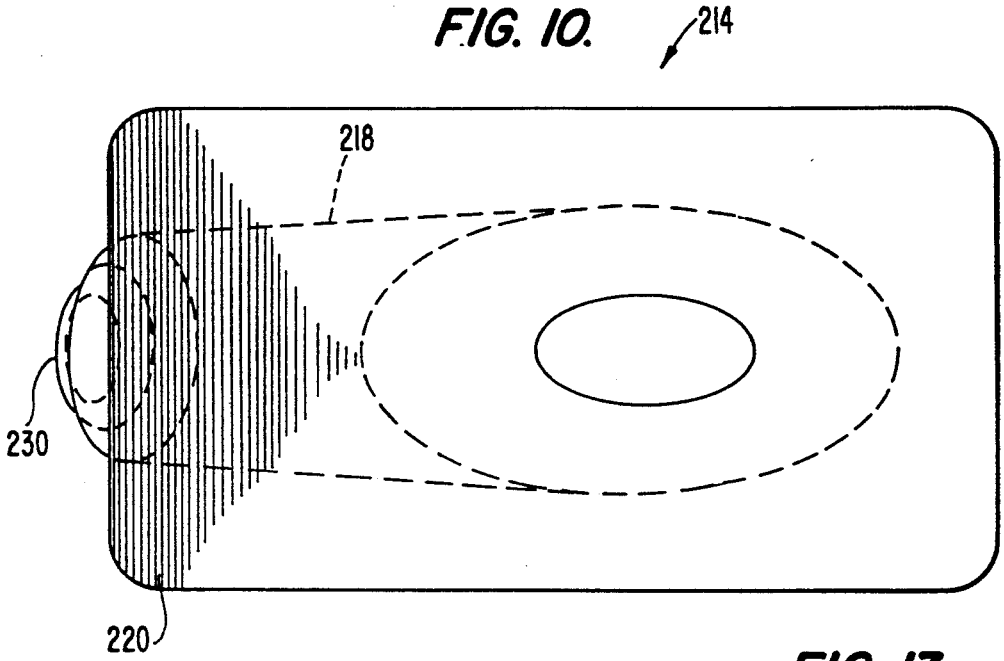
FIG. 10 is a view taken on line 10—10 of FIG. 8.

A bladder and valve assembly of the present invention is shown in FIG. 6 generally at 217. Description of the bladder portion thereof shown generally at 216 is provided with respect to the embodiment illustrated in FIG. 4. The construction and operation of the valve assembly 214 will now be described with reference to FIGS. 6 and 7 as well as a variation thereon as depicted in FIGS. 8–10, and differences between them will also be mentioned. In other words, valve assembly 214 can be substituted for or shows in greater detail the valve 170. The valve assembly 214 uses a firm, but compliant, elongated housing 218 of urethane (Shore A80–90) which is compatible with the urethane film bladder 216. This compatibility allows it to be RF welded in place along the peripheral flange 220. The housing 218 has an air passageway 222 therethrough and in which is secured a spring-biased valve stem assembly shown generally at 224. This valve stem assembly 224 includes an aluminum valve stem 226 having a broad smooth tip 228 which is easy to manipulate with the user's finger tip. The tip 228 can either be rounded as shown in FIGS. 8 and 9 at 230 or have a flat surface 232 with a beveled edge 234 as best shown in FIG. 7. The valve body or housing 218 has a conical-shaped seat area 236, and thus the molded valve housing advantageously functions as the valve seat. The inner end of the valve stem 226 defines an enlarged body member 238 having a flat surface 240. This flat surf ace-conical seat area, in contrast to a conical valve body head, allows for more sealing pressure to be applied and a more compliant spring to be used while still obtaining an adequate seal. This is important when the valve assembly is operated by a person's finger as it is in the present case.

The spring, as shown in FIGS. 6 and 8 at 242, encircles the valve stem 226 and can, for example, be a "302" SST (or plated music) wire compression spring having an outer diameter of 4.86 (or 4.57) millimeters, a wire diameter of 0.48 (or 0.36) millimeters, a free length of 18.34 (or 12.7) millimeters and a spring rate of 0.162 (or 0.49) kilograms per millimeter (or 9.08 lbs/in). When the broad smooth tip 228 of the valve stem 226 is manipulated or pressed down with a finger tip or by other means, the valve stem is pressed inwardly and the plunger end 238 moved inwardly away from the valve seat 236 allowing air to flow therethrough. The valve assembly 214 of FIGS. 6 and 7, unlike that of FIGS. 8–10, has an annular abutment shoulder 244, against which the end of outlet end 206 abuts when hand pump 200 is slipped into place on valve housing 218 for inflating bladder 216 (or bladder 130), as will be explained in greater detail in conjunction with FIGS. 14 and 15.

Thus, unlike standard freon or push-to-deflate valves which are designed to be held together by a crimped metal housing and then attached to a metal can, the valve of the present invention can be connected to the present urethane film bladder. The standard valve is further difficult and uncomfortable to release pressure therefrom by using only one's finger tip.

A standard tire or Schroeder valve, which uses a metal pin and rubber gasket assembly inside of a metal housing, has a valve stem which can be somewhat easier to depress than is the push-to-deflate-valve. However, the metal housing of the Schroeder valve is not readily combinable with the present urethane film, unlike the valve of the present invention.

A needle or Voit type of valve requires a needle to be inserted through a rubber stem for inflation and deflation procedures. This type of valve is difficult, however, to manipulate when a fine pressure adjustment is desired, such as is required in the present footwear application. It is also difficult to regulate the amount of air released by the needle valve from the inflated object inasmuch as that valve is either fully closed or fully open. The needle valve, however, can be made in a material suitable for bonding or welding to a urethane bladder.

One way or check valves which allow flow in only one direction are commonly found in medical devices such as syringes and bulb pumps. A typical check valve has a hard outer housing of metal and plastic and a softer, rubber-like component which seals the valve when air pressure pushes against it. These valves, however, are not suitable for the present purposes since they cannot release air slowly and accurately and since they act in only one direction.

Figure 11:
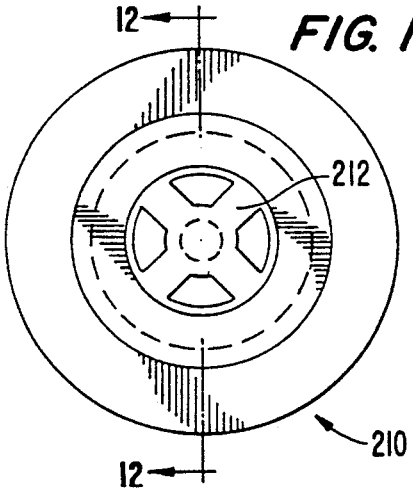
FIG. 11 is an interior end view of a pump nozzle of the hand pump of FIG. 5.
Figure 13:
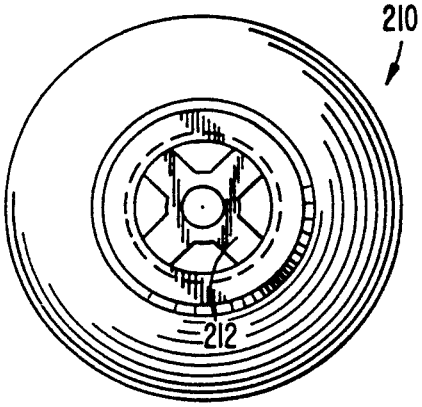
FIG. 13 is an end view of the opposite end of the nozzle of FIG. 5.
Figure 12:
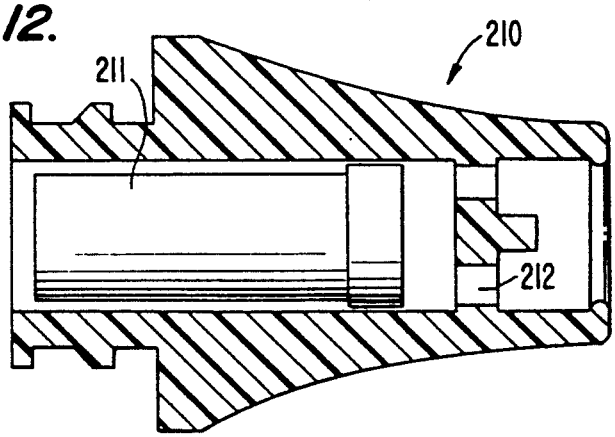
FIG. 12 is a cross-sectional view taken along line 12—12 of FIG. 11.
Figure 14:
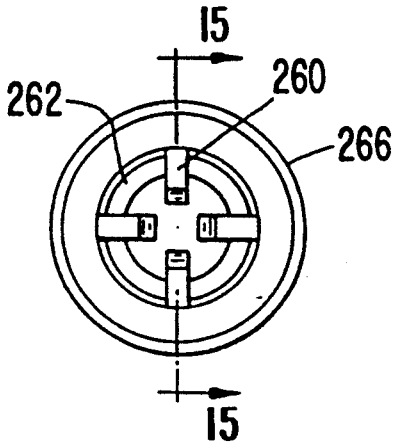
FIG. 14 is an end view of an alternative preferred outlet for the hand pump of FIG. 5.
Figure 15:
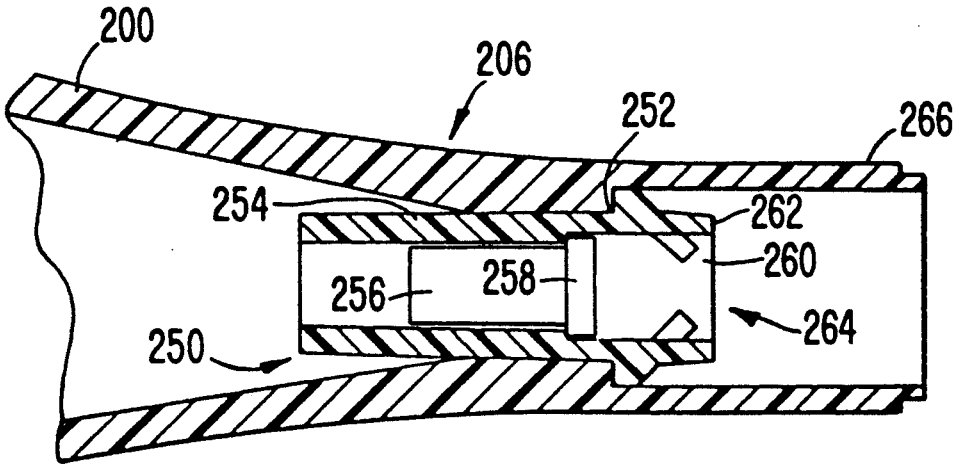
FIG. 15 is a cross-sectional view taken along line 15—15 of FIG. 14 of an alternative preferred outlet end for the hand pump of FIG. 5.

FIGS. 11–13 illustrate one outlet nozzle of the present invention having a connector end (at the left of FIG. 12) adapted to be attached to the body of the hand pump 200. An alternative and preferred outlet nozzle arrangement is illustrated in FIGS. 14 and 15. These two figures show the outlet end 206 of the hand pump 200 with a nozzle 250 built therein against the interior pump shoulder 252. The nozzle 250 defines a cylinder 254 in which plug 256 slides. When in an outward position the head 258 of plug 256 engages the four cross prongs 260. The cross prongs 260 extend radially inward and also angle outward relative to the axis of the cylinder 254, as can be understood from FIGS. 14 and 15. The prongs 260 and the distal end 262 of the cylinder define a seat 264. When the sleeve end 266 of the outlet end 206 is slipped onto and over the elongated housing 218 generally up to the abutment shoulder 244, the seat 264 impacts the tip 228. The valve stem assembly 224 is thereby depressed and the valve assembly 214 opened so that air can be injected by the hand pump 200 into the bladder 216.

Thus, the disclosed valve and pump system is advantageous over the prior art systems because of the reduced number of parts needed. No connectors, extenders or the like are required, and no connecting hose between the pump and the valve is needed since the one-way valve in the nozzle of the pump actuates the valve. A perfect air-tight seal therebetween is not necessary since the pressures and volumes involved are quite small as can be appreciated. Since the system has few moving parts, it is very reliable. Inflation and deflation of the bladder can be easily and accurately accomplished with the present system.

Figure 16:
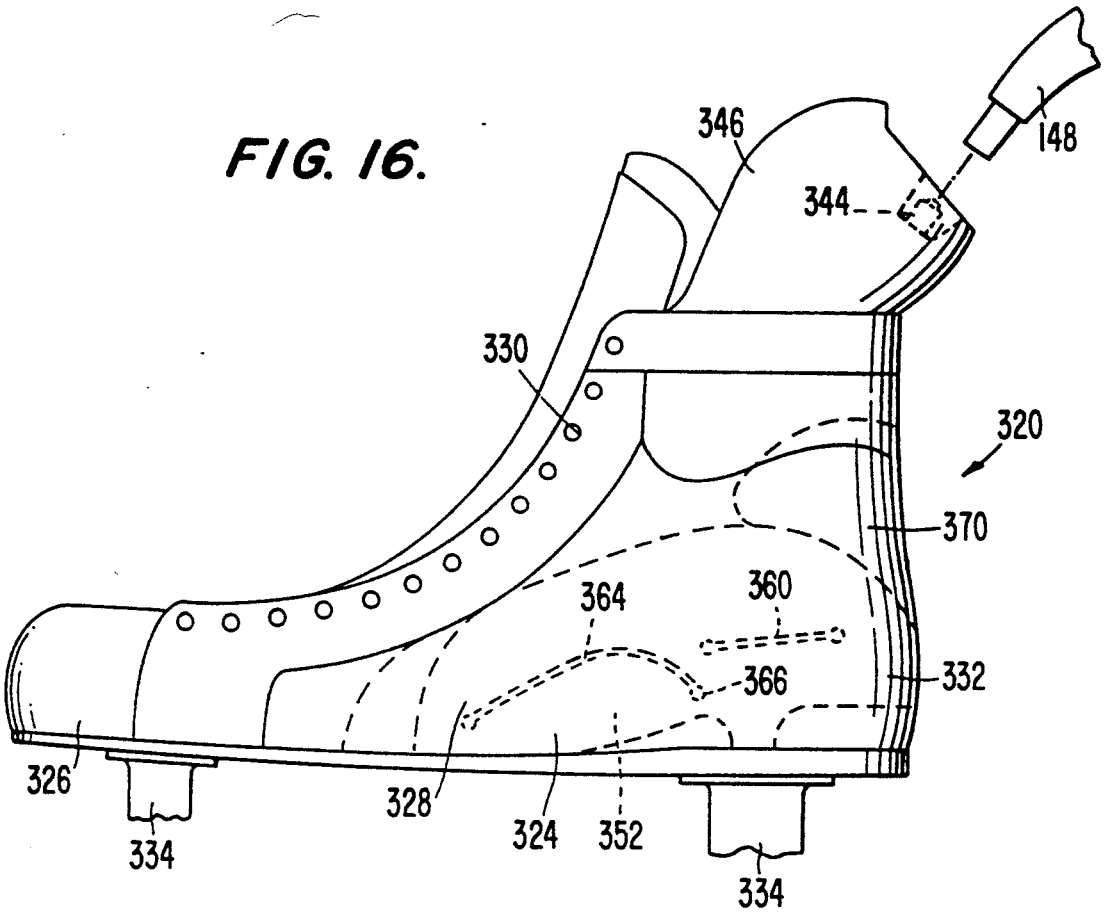
FIG. 16 is a side elevational view of a shoe, particularly a high-top ice skate, of the present invention which includes an alternate inflatable bladder system.
Figure 17:
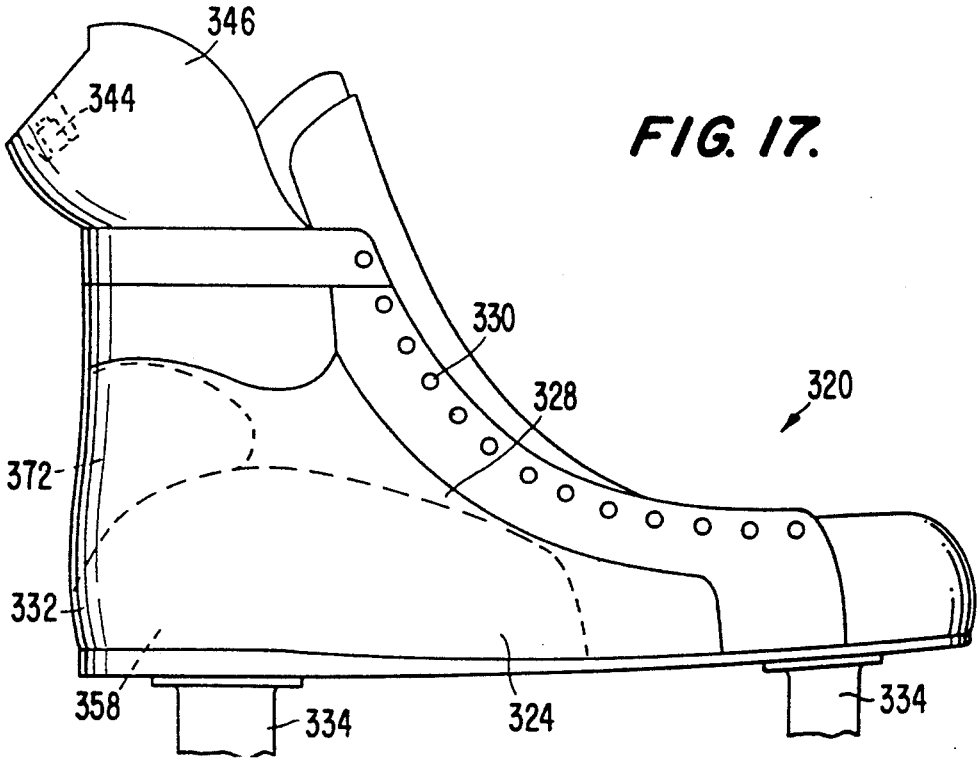
FIG. 17 is a side elevational view of the opposite side of the shoe of FIG. 16.
Figure 18:
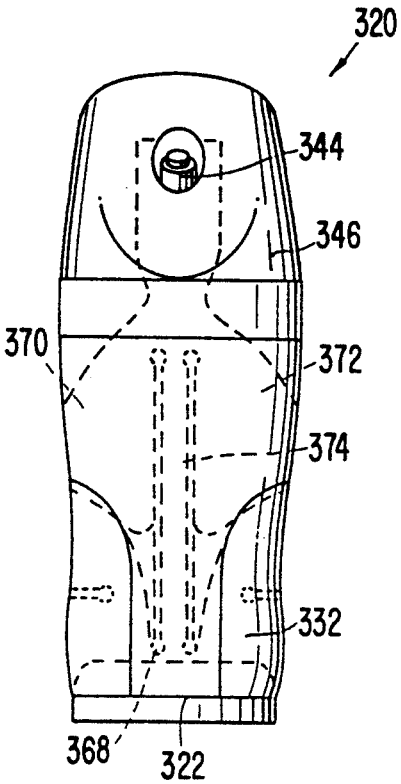
FIG. 18 is a rear elevational view of the shoe of FIG. 16.
Figure 20:
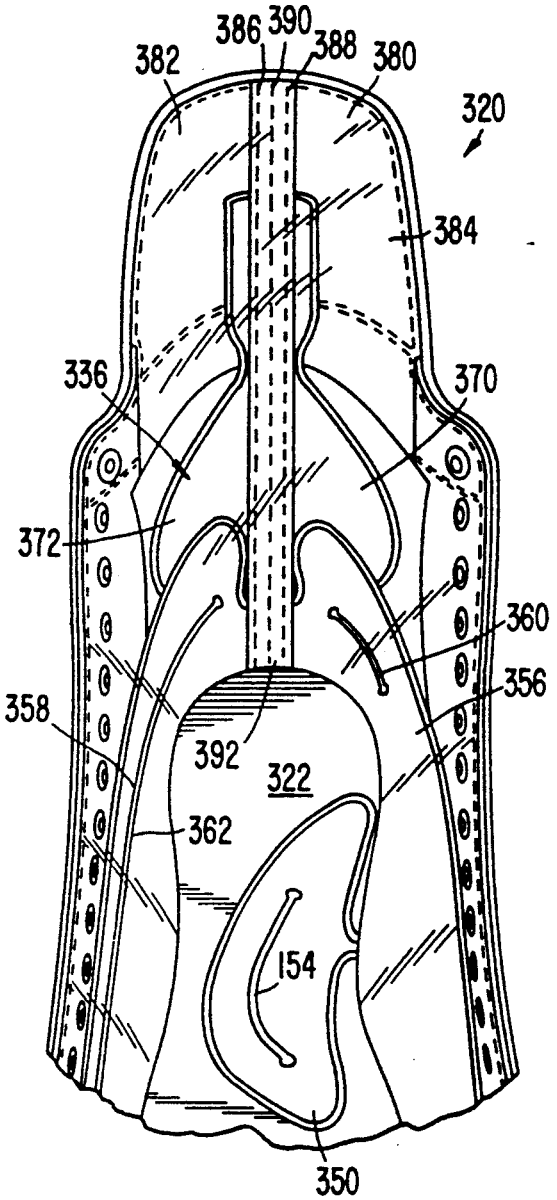
FIG. 20 is a top perspective view of the forward portion of the shoe of FIG. 16, with the tongue thereof pulled forward to more clearly illustrate the bladder system therein.

FIGS. 16, 17 and 20 illustrate an alternative embodiment of an athletic shoe shown generally at 320 in accordance with the present invention. Shoe 320 includes a sole 322 attached in a conventional manner to an upper 324. The shoe 320 is preferably a high-top type of athletic shoe wherein the upper 324 extends around and above the medial and lateral malleoli, indicated as M in FIG. 21. The upper 324 includes a toe portion 326 extending around the area of the toes, an instep portion 328 extending around the instep portion of the foot and including lacing eyelets 330, and an ankle portion 332 extending around the ankle and lower leg. A skate blade 334, whose upper portions are depicted in FIGS. 16 and 17, can be secured beneath the sole 322 so that the shoe 320 thereby forms an ice skate.

Figure 21:
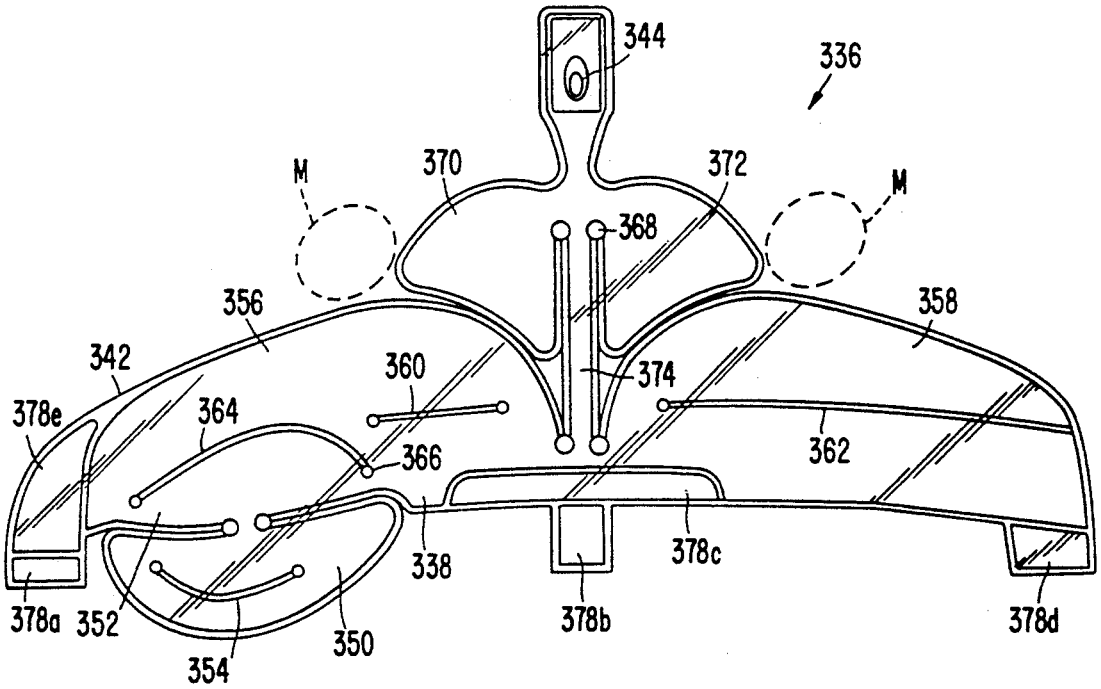
FIG. 21 is a plan view of the inflatable bladder system of the shoe of FIG. 16 shown extended flat and in isolation.

An inflatable air bladder assembly, shown for example in isolation in FIG. 21 generally at 336, is attached inside of the shoe 320 to the upper 324. The bladder assembly 336 is formed of two separate sheets or layers of elastomeric film—an inside layer 338 and an outside layer—which are sealed together along their perimeter edges 342. The air bladder assembly 336 includes a plurality of chambers inflatable to different degrees and positioned to correspond to different concavity areas of the foot. These chambers are connected by air passageways and separated by weld lines, and some are further divided into pockets or subchambers, as will be explained below, to further enhance the fit. Although the chambers are separate and can be inflated to different degrees to accommodate differently configured feet, they are inflatable through the same nozzle or valve stem as shown generally at 344 at the top of the bladder assembly 336. The nozzle or valve stem 344 is preferably of the type illustrated in FIGS. 6–10 and inflated by a pump such as illustrated in FIGS. 5 and 11–15. The valve stem 344 can be located, however, at generally any other convenient location on the shoe 320. It is also within the scope of this invention to provide independent valves for one or more of these chambers.

The valve stem 344 extends out the back of the shoe 320 to be accessible from outside of the shoe. A preshaped shroud 346 of a relatively high density foam material is secured to the upper 324 at the upper top portion of the shoe 320. The shroud 346 has an aperture therethrough through which the valve stem 344 extends to be accessed for inflation and deflation of the chambers of the bladder assembly 336. Since the shroud 346 is formed of a high density foam material, it takes on a relatively fixed, but flexible configuration. The amount of air and thus pressure in each of the chambers can be finely and accurately adjusted by inflating the bladder assembly 336 through the valve stem 344 by gently squeezing the hand pump 200. Accurate deflation then can be made by lightly pressing, as with the finger tip or the opposite end of the hand pump 200, the push-to-deflate nozzle of valve stem 344. In lieu of air, any suitable freeflowing, non-setting fluid can be used to controllably adjust the size and pressure of the chambers.

Figure 19:
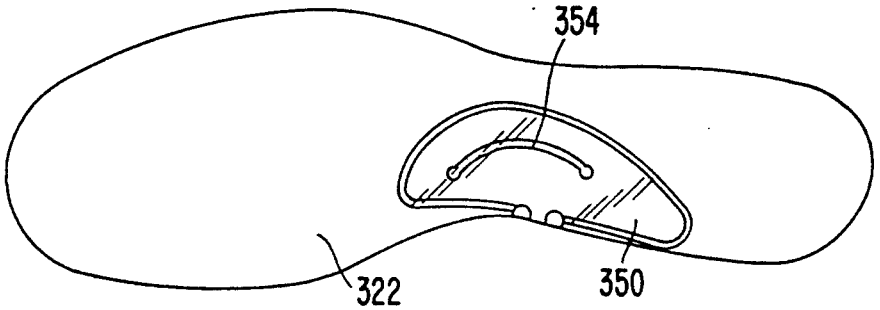
FIG. 19 is a top plan view of the sole of the shoe of FIG. 16 and a portion of the bladder system thereon, illustrated in isolation.

The bladder assembly 336 is divided into a plurality of chambers, as can be seen for example in FIGS. 20 and 21. The arch chamber 350, as can also be seen in FIGS. 16 and 19, has its function augmented by the side arch chamber 352, which is positioned towards the medial side of the foot. These two chambers 350, 352 combine to completely fill in the arch area of the foot. A curved contouring weld 354 centrally positioned in the arch chamber 350 provides an additional contouring fit function. A pair of malleoli or lower heel chambers 356, 358 extend forward to the arch area along the sides of the foot. The malleoli or lower heel chambers 356, 358 are subdivided by contouring welds 360, 362 to provide a contoured filling in of the area of the foot below the malleoli. The heel chamber 356 is separated from the side arch chamber 352 by a contoured weld 364. Weld posts are provided at the free ends of the weld lines—either a relatively small post as shown at 366 or a larger post as shown at 368 for the double or folded layer ends.

Upper heel chambers 370 and 372 for filling in the areas of the foot behind and slightly above the malleoli are provided at the top of the bladder assembly 336 below the valve stem 344. Umbilical passageway or tube 374 extends from the upper heel chambers 370, 372 to the malleoli or lower heel chambers 356, 358. Although this tube 374 is narrow enough to not actually or significantly inflate when the bladder assembly 336 is pressurized, it is wide enough to allow air to pass freely through it thereby communicating the various bladder chambers. The bladder assembly 336 thus fills in the cavities of the arch and ankle of the foot to enhance the fit of the shoe to the foot, rather than to cushion the foot. The bladder assembly 336 does not extend around the entire foot so as to interfere with the fit and particularly does not restrict the plantar and dorsi flexion of the foot. In other words, the numerous chambers within this bladder assembly 336 contour the bladder assembly to the anatomy of the foot without restricting the motion of the foot.

A plurality of tabs 378*a*, 378*b*, 378*c*, 378*d* and 378*e*, as best shown in FIG. 21, extend out from the chambers for stitching the bladder assembly 336 in place in the shoe 320 to the shoe upper 324, and are not themselves inflated. As seen in FIG. 20, a liner 380, preferably a flexible, clear plastic liner, is secured to and in the upper 324 and positioned between the bladder assembly 336 and the foot. This liner 380 allows the foot to be easily slipped into and out of the shoe 320 without dislodging, damaging or getting caught up on any of the chambers of the bladder assembly 336. The liner 380 can be comprised of a pair of flexible sheets 382, 384 stitched along the edges of the upper 324 on both sides thereof. The rear vertical edges of the two sheets 382, 384 are stitched to one or two interconnected elongated webs 386, 388 secured at the top 390 and the bottom 392 of the upper 324 and not fixed along their lengths to the upper 324 so as to not restrict the inflating and deflating movement of the enclosed bladder assembly 336.

Alternatively, this bladder assembly 336 can be molded in place in a polyurethane or latex sockliner or adhered to an EVA or PEEVA liner. Fabric or foam can be applied to the inner surfaces of the chambers to provide slip resistance and comfort to the foot as when the plastic liner is not used. The bladder assembly 336 can be attached to the bottom of a foam sockliner. The heel area and the forefoot area can be left completely exposed to prevent this assembly from interfering with the cushioning of the foot.

Figure 22:
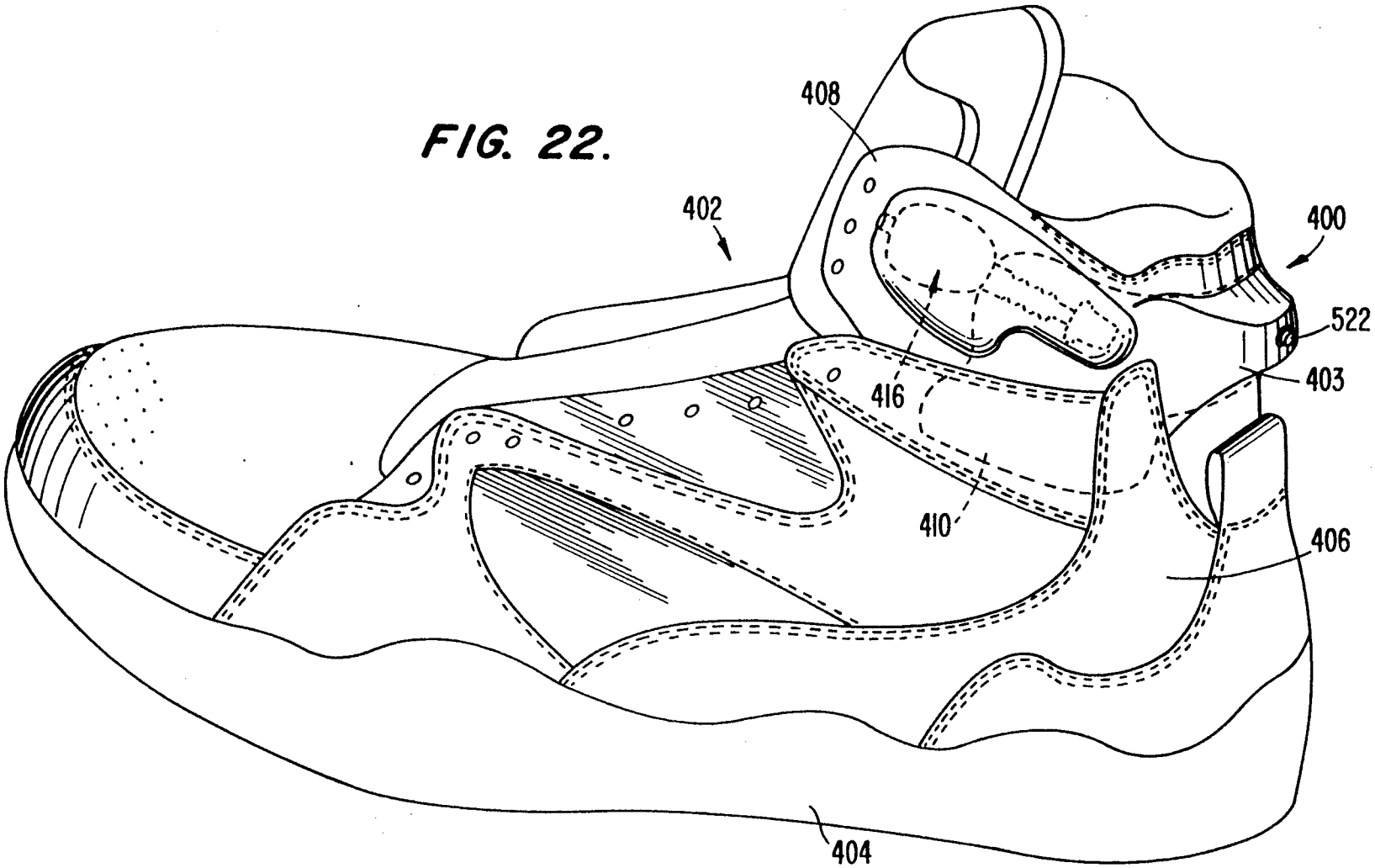
FIG. 22 is a perspective view of a shoe with a bladder pump assembly of the present invention built into it.
Figure 23:
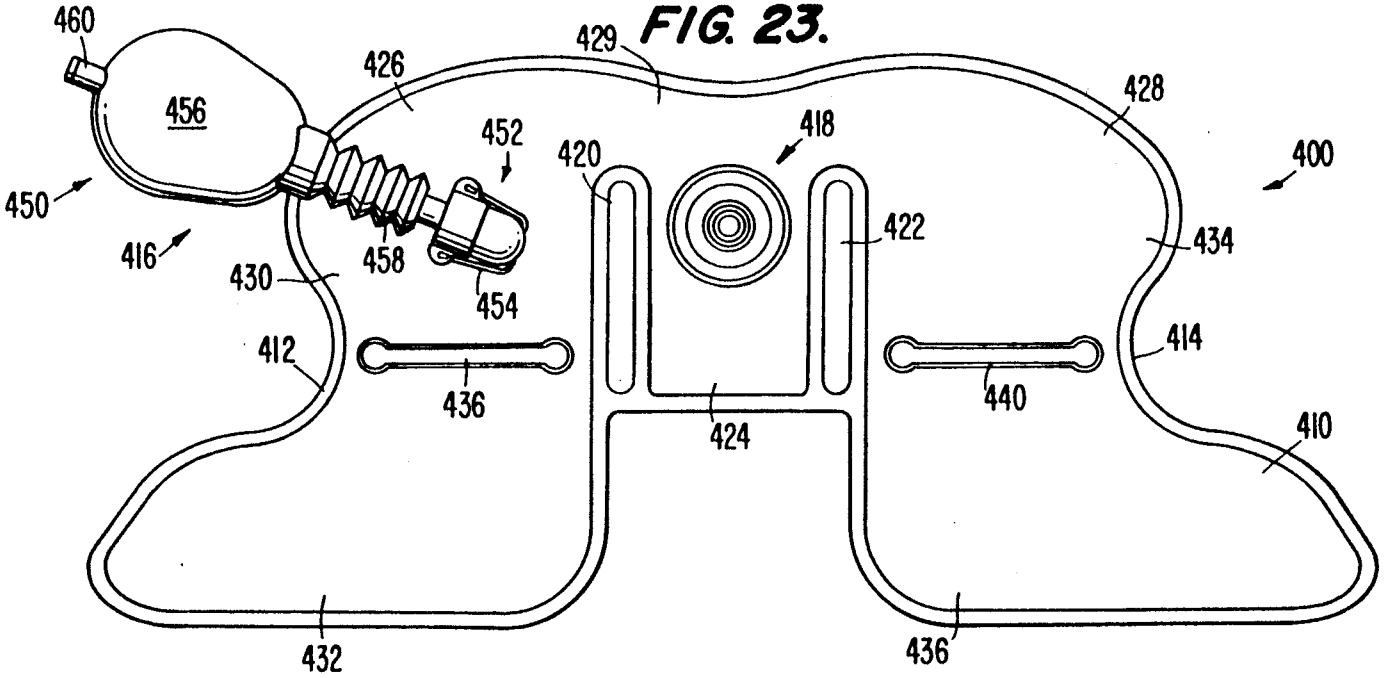
FIG. 23 is a top plan view of the bladder pump assembly of FIG. 22 shown in isolation and laid flat.

A built-in bladder pump assembly embodiment of the present invention is illustrated generally at 400 in FIG. 22 and shown built into a shoe illustrated generally at 402, using a shroud 403. The shoe 402 is shown generically and is preferably a high-top basketball shoe. Examples of such shoes are the AIR FORCE FIVE as illustrated in the NIKE Fall '90 Catalog and the AIR COMMAND FORCE as shown in the Holiday 1990 Catalog. Shoe 402 comprises basically a sole shown generally at 404 and an upper shown generally at 406 and including a collar 408. The procedure for incorporating the bladder pump assembly 400 into the shoe will be described later, and with particular reference to FIGS. 41–43. The bladder pump assembly 400 is shown in isolation and laid flat in FIG. 23. Referring thereto it is seen to comprise a single unit including an ankle bag or bladder shown generally at 410 and as previously described for example with respect to FIG. 4 and designed to fit with the cut-out portions 412, 414 thereof around the ankles of the foot to thereby provide comfort and custom fit of the shoe 402 to individual feet. (The bladder pump assembly 400 can also be used on the bladder of FIG. 21.) A pump assembly shown generally at 416 (and in isolation in FIG. 24) is built into this assembly 400, and unlike the pump of FIG. 5 is permanently affixed to the bladder 410. The pump assembly 416 allows the user, with his foot in the shoe 402, to incrementally increase the pressure in the bladder 410 as needed. To controllably release the pressure a relief valve assembly is provided as shown at 418.

Vertical weld lines 420, 422 on opposite sides of the relief valve assembly 418 define a small and relatively shallow compartment 424 within the bladder 410 and directly beneath the relief valve assembly. These weld lines 420, 422 also separate the bladder 410 into left and right or lateral and medial wing areas 426, 428 which communicate directly with each other and directly with the center chamber or compartment 424 through a top passageway 429. Both of the wing areas 426, 428 are divided generally into upper and lower chambers 430, 432, 434, 436 by horizontal weld line segments 438, 440, respectively, which join the inner and outer layers of the bladder together. As previously described, these weld line segments 438, 440 prevent the formation of restrictive vertical columns of air in the bladder 410. They do not, however, prevent the controllable inflation and deflation of the chambers in that air can flow between the upper and lower chambers 430, 432, 434, 436 at either ends of the weld line segments 438, 440 but through passages 442, 444, 446, 448 so narrow as to not form any significant rigid air columns when the bladder 410 is inflated.

Figure 24:
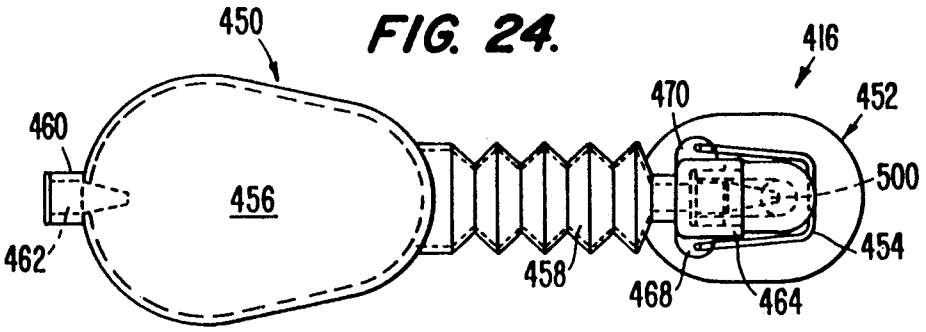
FIG. 24 is an enlarged view of the pump assembly element of the bladder pump assembly FIG. 23 shown in isolation.
Figure 25:
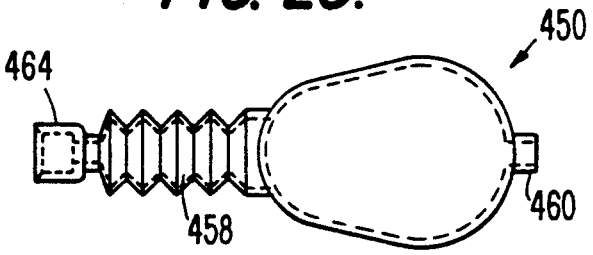
FIG. 25 is a plan view of the bulb pump of the pump assembly of FIG. 24.
Figure 26:
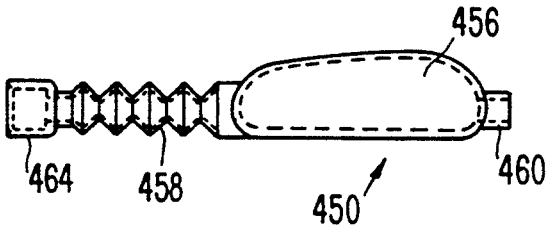
FIG. 26 is a side elevational view of the bulb pump of FIG. 25.
Figure 27:
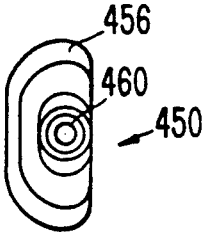
FIG. 27 is an end elevational view of the bulb pump of FIG. 25.

The pump assembly 416 is shown enlarged and in isolation in FIG. 24, and comprises three integral components—a pump as shown generally at 450, a weld flange as shown generally at 452 and a bail 454 for providing secure connection of the bulb pump to the weld flange. The pump 450, which is shown in isolation in FIGS. 25–27, is advantageously formed as a single integral unit by a blow molding procedure. In other words, the compressible bulb pump 456 and the elongated bellows connector 458 are formed together as one unit. Unlike the prior art techniques of using adhesives to connect the passageway and the compressible pump, the present integral holding connection is dependable. The connecting tubing is formed as a bellows or an accordion style connector 458, which conveniently allows the adjustment of the placement of the compressible bulb pump 456 with respect to the bladder 410 and the shoe 402 as needed for different shoes. Thus, only a single size of pump 450 needs to be molded to accommodate shoes of many sizes, from sizes six to thirteen, or eight to fourteen. Three or four different sizes of bladders 410, however, may be needed to accommodate the variations in the different sizes of shoes.

Figure 28:
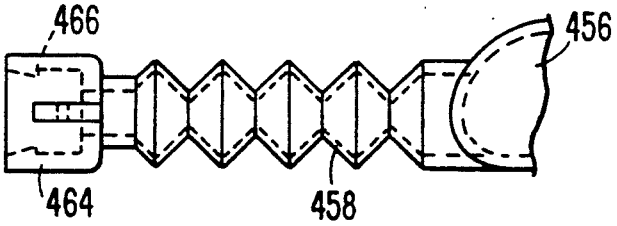
FIG. 28 is an enlarged side elevational view of the connector end of the bulb pump of FIG. 25.

An inlet sleeve 460 at the inlet end of the compressible bulb pump 456 holds a one-way inlet Vernay duckbill valve 462 (FIG. 24). One-way valve 462 allows the flow of air relative to the ambient or surrounding air only into the bulb pump 456 when the compressed bulb is released and not out of the bulb pump through the inlet sleeve 460 when the bulb pump is compressed. In other words, the valve 462, which is located at the back end of the bulb pump 456, blocks air, by closing the valve slit, from passing out the back of the bulb pump due to back pressure created when the bulb pump is depressed or squeezed. And when the bulb pump 456 is released, ambient air flows into the bulb pump through the valve 462, replenishing the bulb pump and readying the pump assembly 416 for the next pumping cycle. When the bulb pump 456 then is compressed the air therein is forced out the elongated bellows connector 458 through the end cup 464 and into the weld flange 452. The end cup 464 which is an integral part of the bellows connector 458, and hence of the bulb pump 456, is open at its end and the air flows therethrough. The inner surface of the cup 464 has optional undercuts or barbs 466 as shown in FIG. 28 and the outer surface of the cup has a pair of ears 468, 470, each having an opening 472, 474, respectively, therethrough. Both the ears 468, 470 and the barbs 466 are provided as part of the novel mechanical fit of the pump 450 to the weld flange 452 of this invention.

Figure 32:
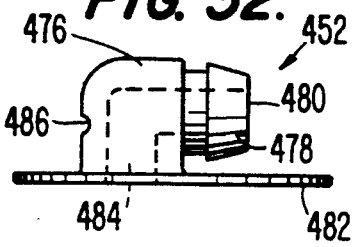
FIG. 32 is a side elevational view of the weld flange of the bladder pump assembly of FIG. 23.
Figure 33:
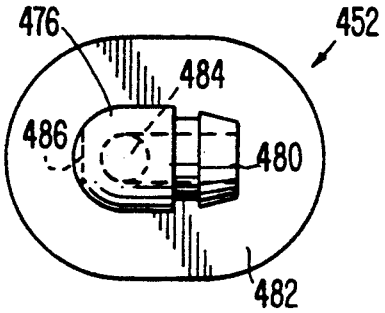
FIG. 33 is a top plan view of the weld flange of FIG. 32.

The weld flange 452 is best shown in FIGS. 32 and 33 and includes an angled pipe 476 having a male end 478 and at the male end a nib 480 having a conical outer surface. The angled pipe 476 defines a housing which is mounted and integrally formed with a radial mounting flange 482. The flange 482 and housing 476 which are made of a material compatible with that of the urethane bladder 410, and can thus be and are RF welded to the bladder over the bladder opening such that the angled air passageway 484 through the weld flange 452 is directly over the opening. A horizontal groove 486 is formed on the back side of the housing 476 for the connector bail 454.

Figure 29:
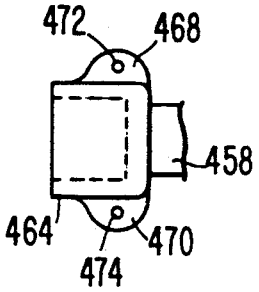
FIG. 29 is a top plan view of the end of the connector end of FIG. 28.
Figure 30:
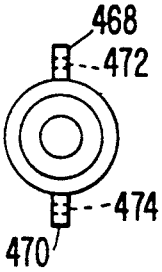
FIG. 30 is an end elevational view of the connector end of FIG. 29.
Figure 31:
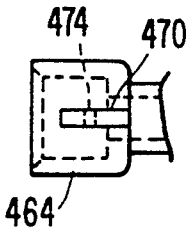
FIG. 31 is a side elevational view of the connector end of FIG. 29.
Figure 34:
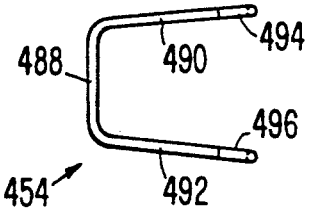
FIG. 34 is a top plan view of the bail element of the bladder pump assembly of FIG. 23, illustrated in isolation.
Figure 35:
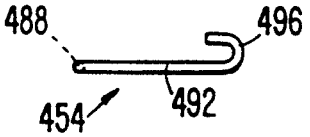
FIG. 35 is a side elevational view of the bail of FIG. 34.
Figure 36:
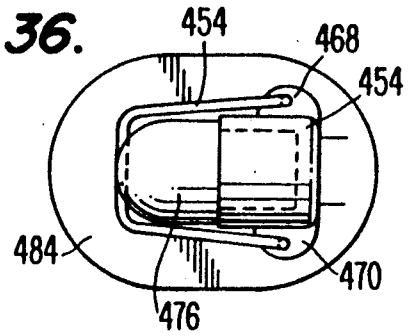
FIG. 36 is a enlarged top plan view of the pump assembly connector of the pump assembly of FIG. 24, including the bail of FIG. 34.

The connector bail 454, shown in isolation in FIGS. 34 and 35, comprises a generally U-shaped piece of wire having a base portion 488 and two leg portions 490, 492 extending out therefrom and having hooks 494, 496, respectively, at their ends. The hooks 494, 496 can hook into the corresponding openings 472, 474 of the ears 468, 470 as best shown in FIGS. 24 and 29. When the cup 464 is press fit over the male member end 478 of the weld flange 452, the nib 480 locks onto the barbs 466 in an interference engaging type of fit, resembling interlocking teeth, as can be understood from FIG. 24. The bail 454 is then snap fit into the groove 486 to provide a safety catch securement, as depicted in FIG. 36.

Similar to the Vernay duckbill valve 462 at the inlet sleeve 460 of the bulb pump 456, there is a second Vernay duckbill valve 500 in the weld flange 452 as shown by the dotted lines in FIG. 24. Thus, with the weld flange 452 RF welded in place over the opening of the bladder 410 and to the bladder and the double mechanical securement (454–486 and 480–462) securing the pump to the weld flange 452, the bladder pressurizing means is in place. The bulb pump 456 is expanded when in its natural state, and when manually compressed air is forced through the bellows connector 458, the weld flange 452 and into the bladder 410, and when released air is blocked from flowing into the bulb pump from the bladder, but flows freely in through the inlet sleeve 460 into the bulb pump to deflate it. Each compression of the bulb pump 456 incrementally inflates the bladder 410, and each one of the chambers in the bladder will be custom inflated to accommodate the foot in the shoe 402, with only a few squeezes or depressions of the bulb pump. If the bladder 410 is over inflated or deflation is desired as for example to adjust the fit, the pressure release valve assembly 418 is operated.

Figure 37:
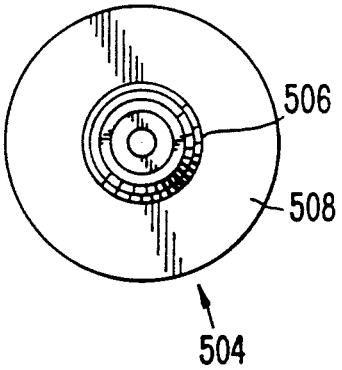
FIG. 37 is a top plan view of the housing component of the relief valve assembly of the bladder pump assembly of FIG. 23.
Figure 38:
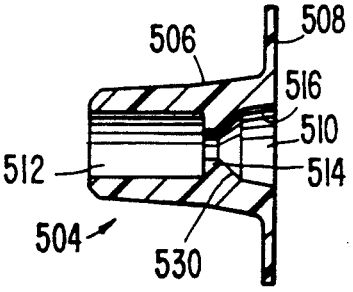
FIG. 38 is a cross-sectional view of the housing of FIG. 37.
Figure 39:
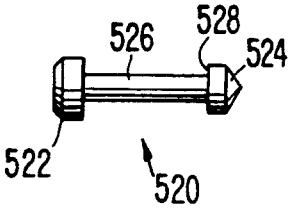
FIG. 39 is a side elevational view of the valve plunger of the relief valve assembly of FIG. 23.
Figure 40:
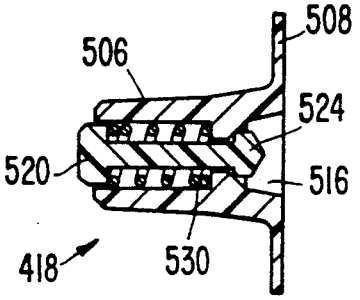
FIG. 40 is a cross-sectional view of the relief valve assembly of FIG. 22 showing the housing of FIGS. 37 and 38, the plunger of FIG. 39 and the internal helical biasing spring.

The pressure release valve assembly 418 is shown in cross-section in FIG. 40, and is similar to the press-to-deflate valves described previously herein. Consisting of only three components, its construction and operation are very easy and dependable, and no gasket or the like is needed. It can also be made very small and thus light weight, which is very important in today's athletic shoes, while still retaining the ability to accurately deflate the bladder 410 with only the touches of a fingertip. A single-piece plastic molded valve housing 504 (FIGS. 37 and 38) of the assembly 418 has a housing portion 506 and a radial flange 508 which is attached to the bladder 410. This attachment can be by RF welding, sonic welding or heat sealing. An air passageway 510 is formed longitudinally through the housing portion 506 to communicate with the release opening in the bladder 410. The housing portion 506 is configured to define a cylindrical spring chamber 512 within this passageway 510 near the end of the housing portion, an interior valve seat 514 at the inward end of the spring chamber 512 and forming a constriction in the passageway 510, and a plug chamber 516 at the other end of the valve seat. The plunger 520 of the assembly 418 and as shown in isolation in FIG. 39 has a plunger head 522 at one end, a plunger plug 524 at the other end and a relatively narrow plunger stem 526 extending between them. The helical compression spring 530, as shown in FIG. 40, is disposed around the stem 526 and in the spring chamber 512.

To assemble the relief valve assembly 418, the plunger plug 524 is pushed through the resilient valve seat 514 to thereby be positioned in the plug chamber 516. Since the top surf ace 528 of the plunger plug 420 is flat and the valve seat 514 defines a lower conical surface 530, the engagement of the plunger plug against the valve seat is advantageously only along the top outer peripheral edge of the plunger plug. This is similar to that of the arrangement shown in FIG. 7, for example. The spring 530 bears against the bottom surface of the plunger head 522, pulling the plunger plug 524 into engagement with the valve seat 514 and thereby closing off the passageway 510 and maintaining the relief valve assembly 418 in a normal closed position. The spring 530 in its natural state bears against the underneath of the plunger head 522 and pushes the plunger head up so that it is exposed beyond the top edge 532 of the valve housing portion 506. The head 522 can thereby be easily accessed by a fingertip and with only a fingertip depression the plunger head 522 and thus the plunger plug 524 are depressed downwardly, against the bias of the spring 530 and the plunger plug is pushed away from the valve seat 514. This opens the passageway 510 so that air pressure can be released from the bladder 410 through the relief valve assembly 418, which is then in a depressed open position.

Figure 41:
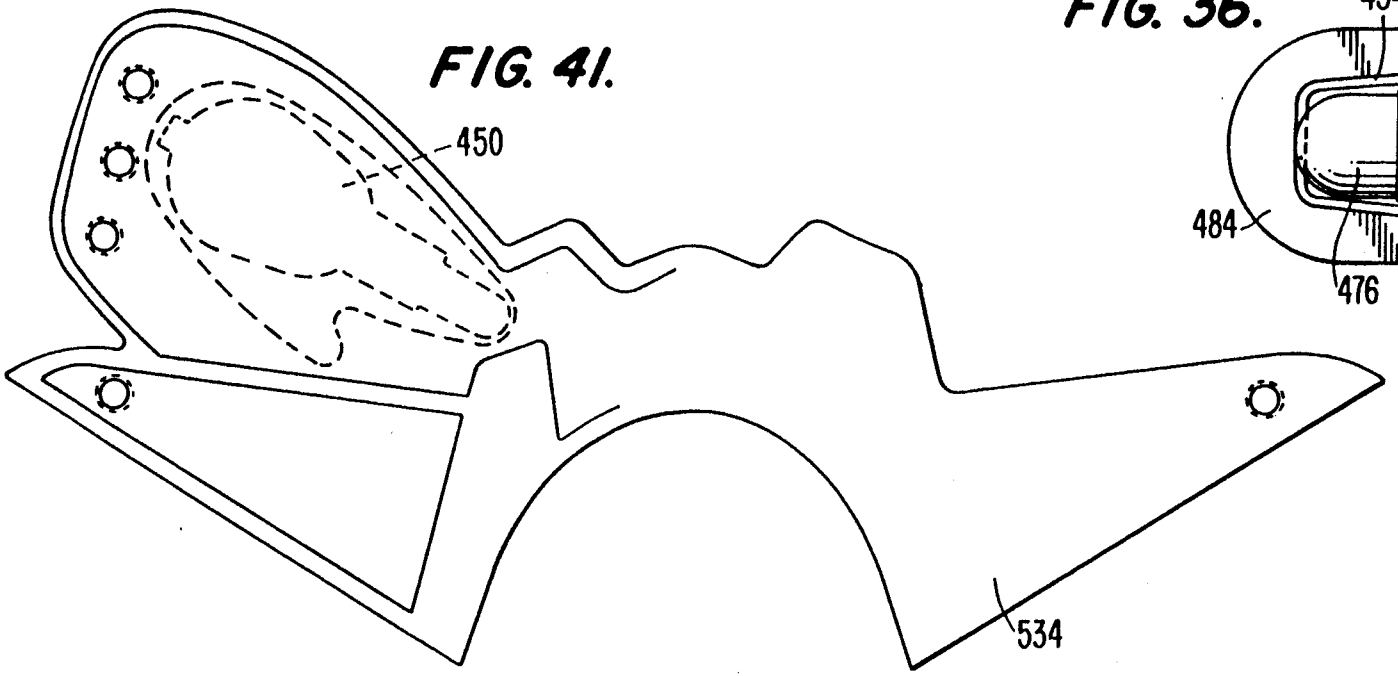
FIG. 41 is a top plan view of a shroud and pump receptacle of the present invention and a variation of that shown on the shoe of FIG. 22.
Figure 43:
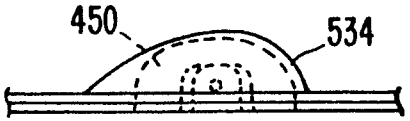
FIG. 43 is an end view of the pump portion.
Figure 42:
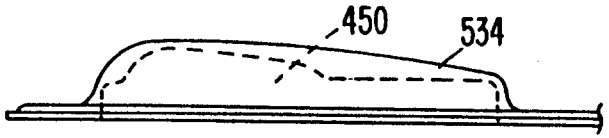
FIG. 42 is a top plan view of the pump portion of the shroud of FIG. 41.

FIGS. 41–43, while showing shroud and pump receptacle of the present invention generally at 5 34 which is slightly different than the shroud 403, illustrate the relative location of the pump 450 as would be found in the shoe 402 of FIG. 22. Assembly of the bladder pump assembly 400 into the shoe 402 is easy because of the design of the shoe and the bladder pump assembly. The back valve stem or head 522 is stuck out through the molded hole 536 of the shroud 534. The shroud 534 has a molded receptacle contour that goes on the outside of the upper 406 and the bulb pump 456. Once the plunger head 522 has been poked out through the hole 534 such that the relief valve assembly 418 is horizontally disposed, the entire bladder pump assembly 400 is generally lined up correctly with the bulb pump 456 on the outside side of the shoe 402. (It is also within the scope of this invention to have the relief valve assembly 418 in an angled down position such as is shown in FIGS. 1 and 16.) The bulb pump 456 is then pushed into place in the molded pump piece of the outer shroud 534 and the outer shroud stitched to the upper 406 of the shoe 402. Although a low grade adhesive may be used to tack the pump assembly into place during assembly, a high grade adhesive is not necessary since the assembly fits into the pocket defined by the shroud 534 and the shoe 502 and is held therein by the attachment of the shroud to the shoe. Due to the unique bellows connector 458 the bulb pump 456 can be manipulated both radially and angularly relative to the weld flange 452 and the bladder 410 to accommodate different size shoes, as explained previously.

Thus, the bladder pump assembly 400 is a self -contained system and does not require a detached off-board pump (148). It is small enough to be positioned on and become an integral part of the shoe 402. Manufacturing thereof is easy due to the press interference fit and the absence of cemented joints. The bellows connector 458, being integral with the bulb pump 456, eliminates the connecting tubes needed in the past and their probability of failure. Since the bellows connector 458 is flexible, one pump size can be used for the complete size range of shoes and some inaccuracies in the placement of the pump during shoe assembly are also thereby accommodated.

Figure 45:
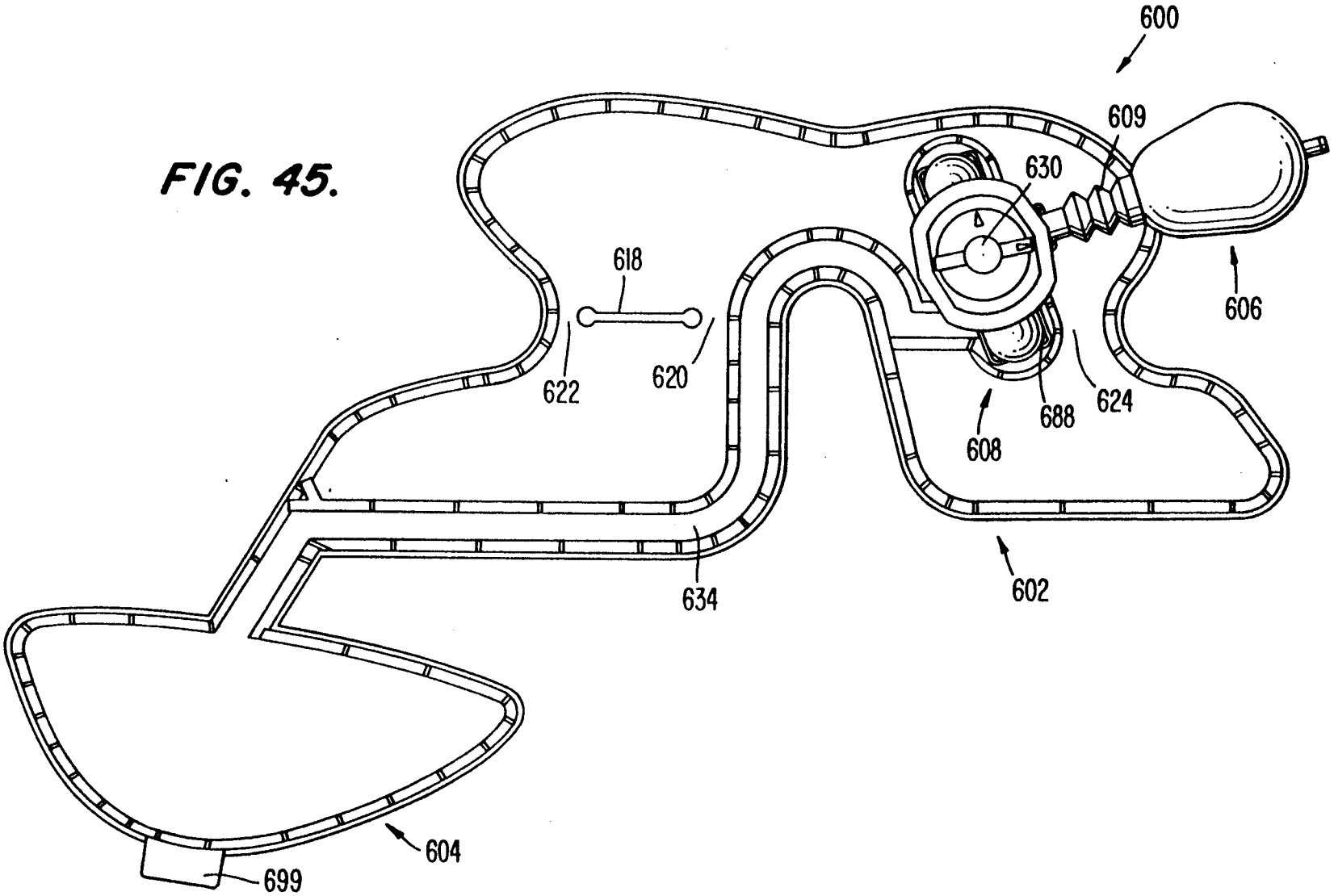
FIG. 45 is a top perspective view of the bladder assembly of FIG. 44 shown in isolation and laid flat.
Figure 46:
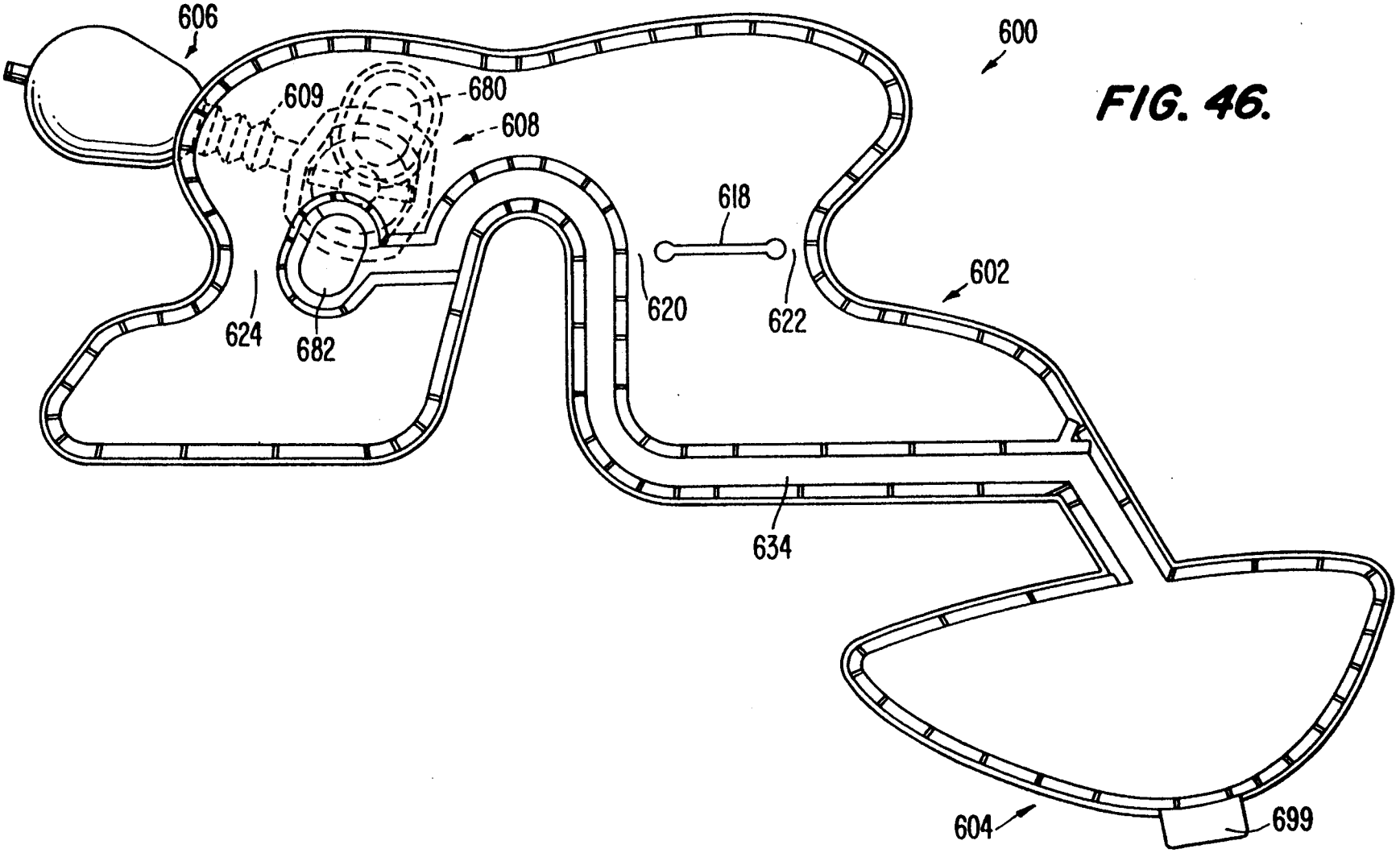
FIG. 46 is a bottom plan view of the bladder assembly of FIG. 45.

In the previously-described shoe bladder embodiments, a number of inflatable chambers are formed by the configuration of the bladder and the use of weld lines. These chambers can be inflated to different volumes to generally accommodate different feet and different fits. All of those chambers, however, are interconnected by narrow passages and are inflated from the same source and thus, when inflated, will have the same pressure, such as a three psi pressure. Although this may be adequate for some individuals and for some feet, it does not meet the ideal fit and comfort requirements of many athletes, as the different concavity areas of the foot require different pressures. In particular, the arch area, the metatarsal areas and the ankle areas often require different pressures. Proper fit of the shoe is important for all athletic activities, and all fit components of the shoe are interrelated. Accordingly, a further embodiment of the present invention provides for independent pressurization of at least two of the chambers in each shoe. This bladder assembly is shown in FIGS. 45 and 46, for example, generally at 600. It is further understood that different features of the numerous embodiments as shown and illustrated in this disclosure can be variously combined as would be within the skill in the art.

Referring to FIG. 45, the bladder assembly 600 is shown to comprise basically an ankle fit bladder, bag or chamber as shown generally at 602, an arch support bladder or chamber as shown generally at 604 physically connected to, but not in fluid or pressure communication with, the ankle bag, an on-board articulated bulb pump as shown generally at 606, and a valve mechanism as shown generally at 608. The bulb pump 606 has an articulated connector 609 similar to bellows connector 458. The bulb pump is also held on the outside of the shoe 610 in and by a shroud similar to shroud and pump receptacle 534 and shaped to receive the bulb pump 606 in the upper collar portion 612 of the shoe, as can be understood from FIG. 44. The egg-shaped arch chamber 604 will preferably have one or more central weld lines (not shown) similar to weld line 354 so that it is not too large and does not have a large center peak. A weld line provides for a gradual wedge-type shape more closely resembling and conforming to the shape of the arch of the foot. The medial weld line 618 of the ankle fit bladder 602 prevents the formation on the medial side of restrictive vertical air columns by defining only thin communication areas 620, 622, similar to areas 166. If lateral passageway 624 proves to be too large, a lateral weld line segment (not shown) can be added. Numerous different elastomeric materials can be used for the arch and ankle bladders 602, 604. A number of factors may be considered in making this selection including the material's softness, suppleness, durability, ease of manufacture, resistance to fatigue failure, ease of attachment to the other system components, fit around the foot, and the anticipated activities of the user. Suitable materials include PVC, urethane, rubber and polyurethane, and a specific preferred material for bladders 602, 604 (or for any of the other bladders herein) is eighteen gauge, ninety-five Shore A durometer, ester-based polyurethane.

Figure 48:
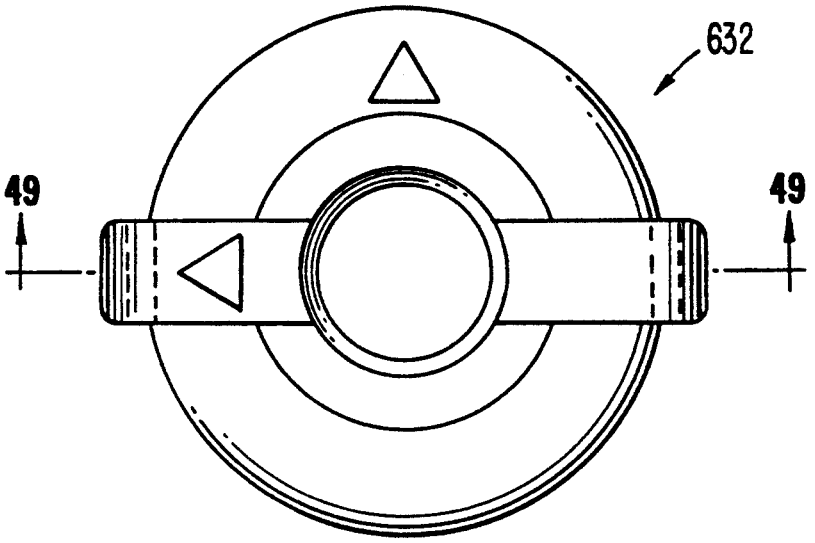
FIG. 48 is a top plan view of the button of the valve mechanism of FIG. 47.
Figure 49:
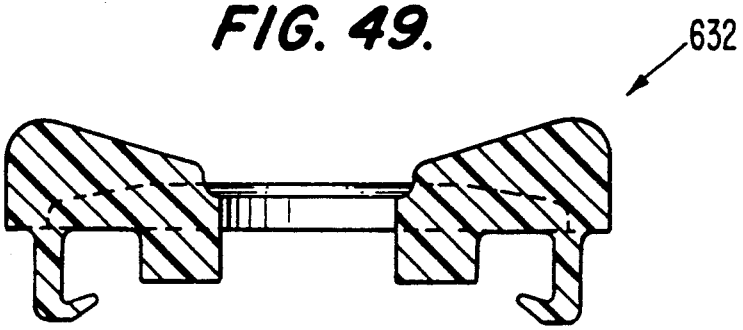
FIG. 49 is a cross-sectional view taken along line 49—49 of FIG. 48.
Figure 50:
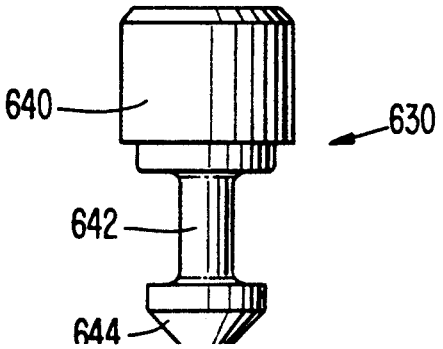
FIG. 50 is an elevational view of the plunger of the valve mechanism of FIG. 47.

The valve mechanism 608 includes a centrally disposed push-to-deflate plunger 630 (FIG. 50). The top dial or button 632 (FIGS. 48 and 49) encircling the plunger 630 can be turned to any of three positions. When in the first position, the bulb pump 606 and the deflation plunger 630 are in operative fluid communication with the ankle chamber 602. When in the second position, turned ninety degrees relative to the first, the bulb pump 606 and the deflation plunger 630 are in an operative fluid communication through an RF welded passageway 634 with the arch support chamber 604. When in the third position, between the first and second positions, the bulb pump 606 and deflation plunger 630 are not in communication with either of the bladders 602 or 604, and thus no inflation or deflation of either of them can take place. This third position is a safety feature to ensure that the bladders 602, 604 cannot be inadvertently inflated or deflated as by impact during active play. Thus, when the button 632 is rotated to its different positions, different passageways are caused to communicate with each other and the bladders 602, 604 and the inflation bulb pump 606 and the deflation plunger 630 are selectively placed into or out of communication with each other. This will become more apparent from the description below of the operation and construction of the valve mechanism 608.

Figure 44:
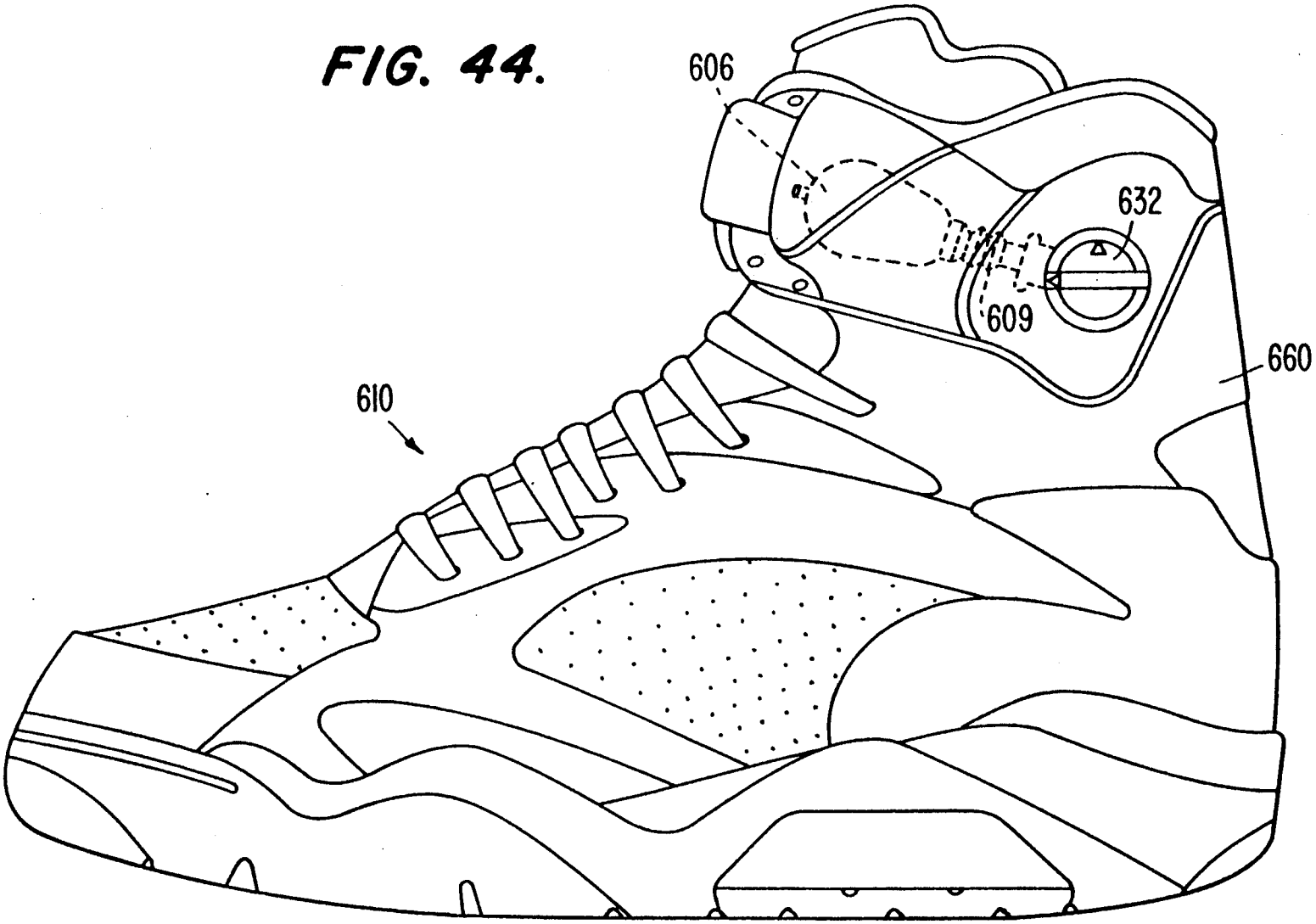
FIG. 44 is a lateral side elevational view of a shoe incorporating a bladder assembly of the present invention.
Figure 47:
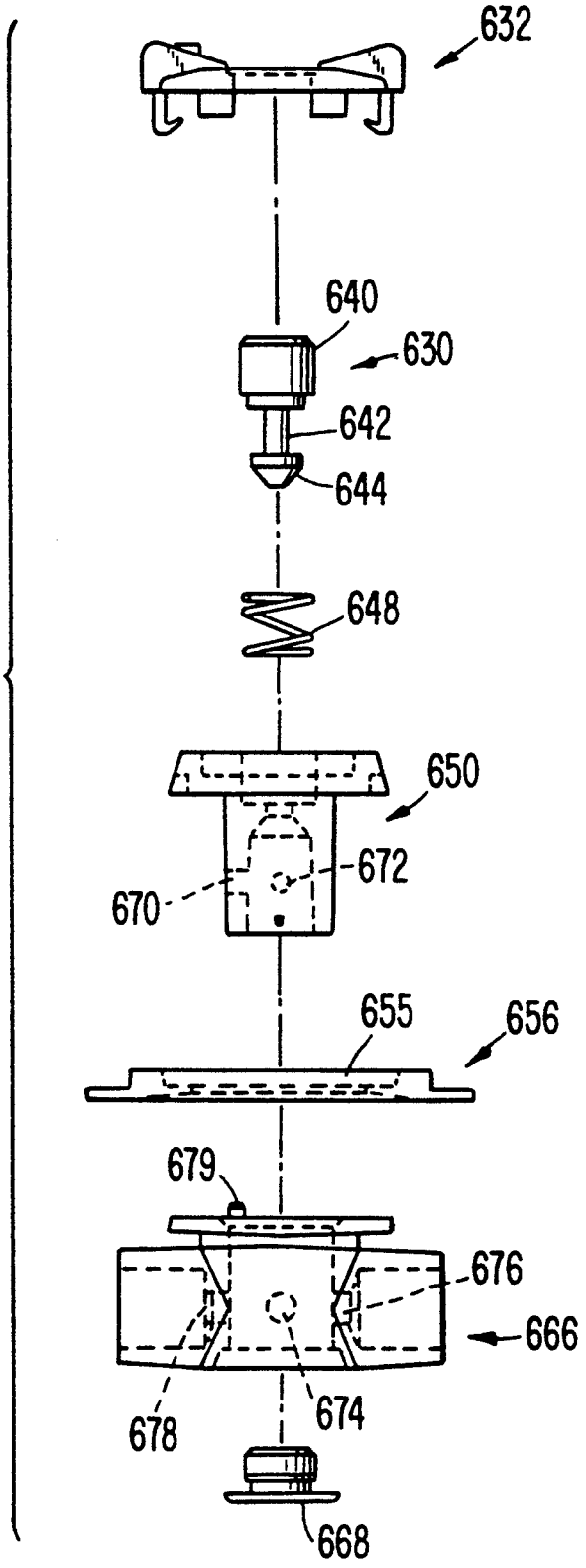
FIG. 47 is an exploded perspective view of the valve mechanism of the bladder assembly of FIG. 45.
Figure 51:
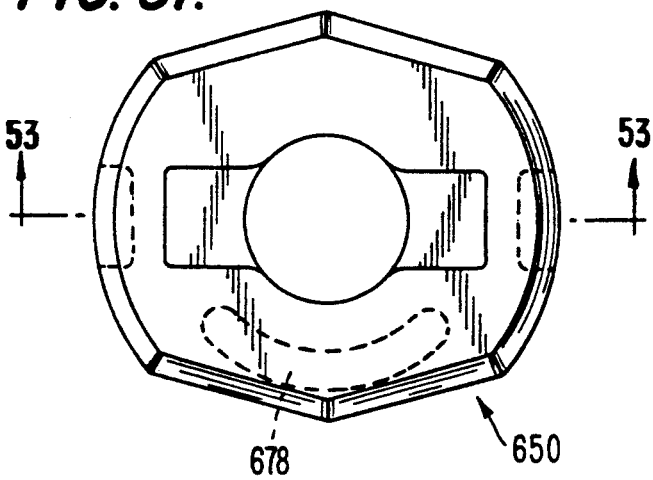
FIG. 51 is a top plan view of the barrel member of the valve mechanism of FIG. 47.
Figure 52:
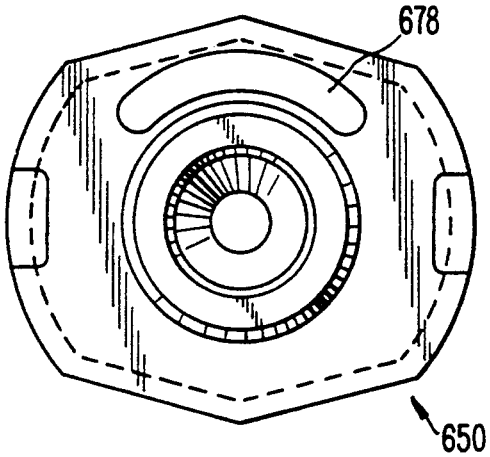
FIG. 52 is a bottom plan view of the barrel member of FIG. 51.
Figure 53:
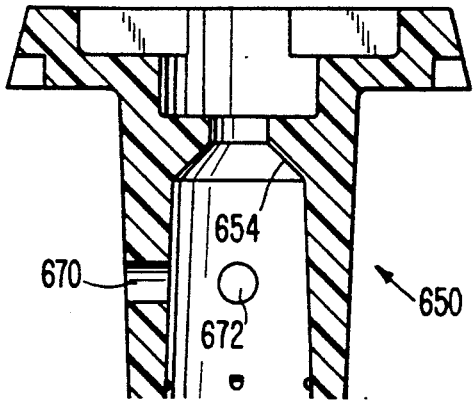
FIG. 53 is a cross-sectional view taken along line 53—53 of FIG. 51.
Figure 54:
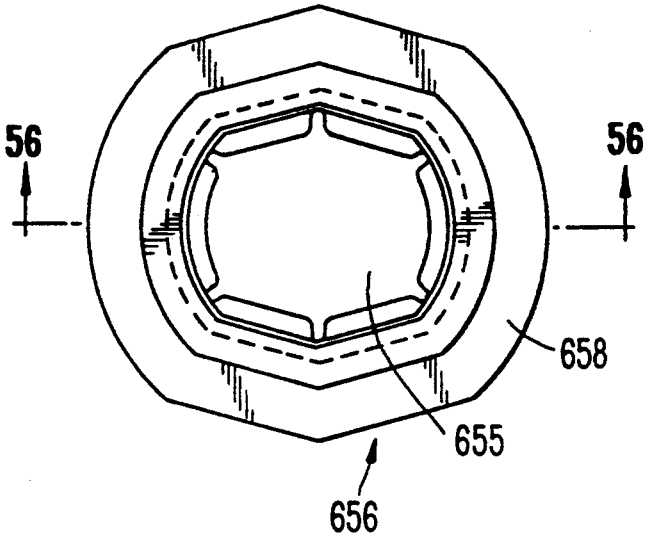
FIG. 54 is a top plan view of the snap ring of the valve mechanism of FIG. 47.
Figure 55:
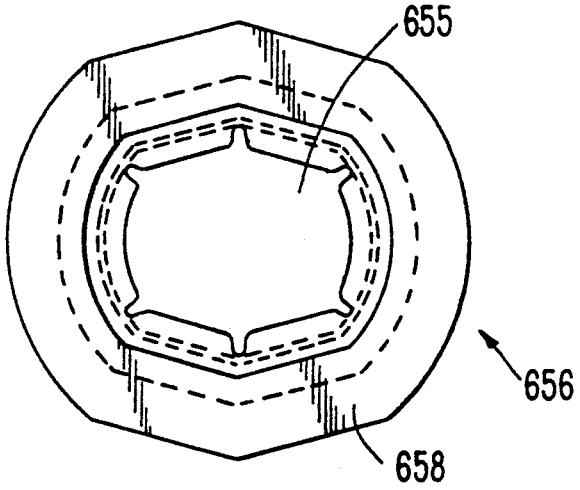
FIG. 55 is a bottom plan view of the snap ring of FIG. 54.
Figure 56:
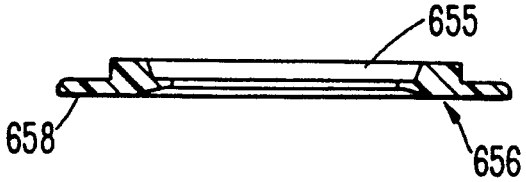
FIG. 56 is a cross-sectional view taken along line 56—56 of FIG. 54.
Figure 57:
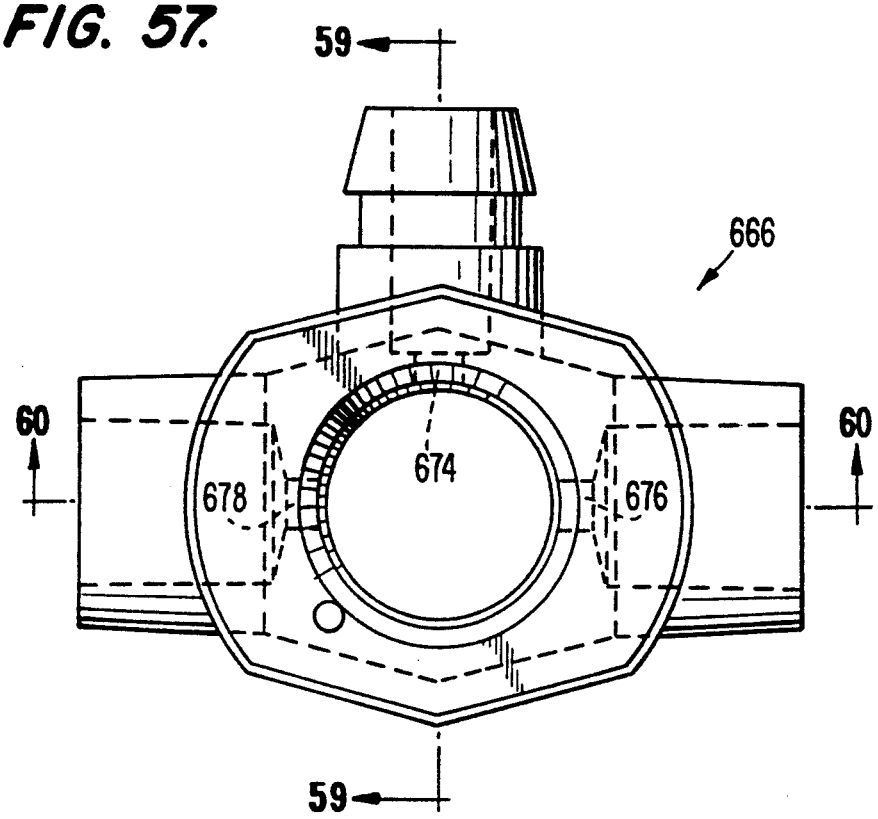
FIG. 57 is a top plan view of the tee member of the valve mechanism of FIG. 47.
Figure 58:
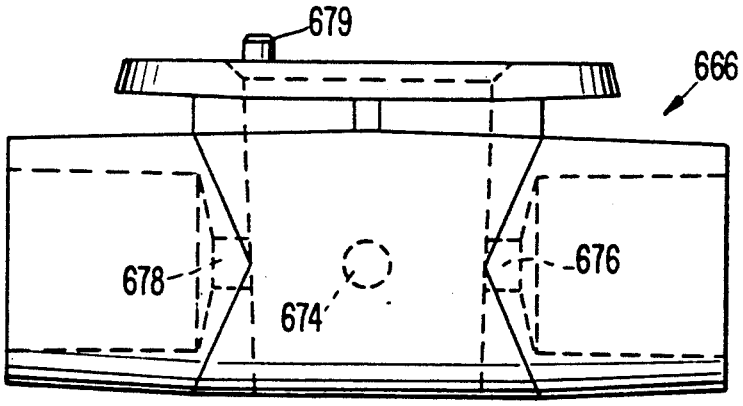
FIG. 58 is a side elevational view of the tee member of FIG. 57.

Referring to FIG. 47, the valve mechanism 608 is illustrated with its components in exploded relation for purposes of explanation. The plunger 630 (FIG. 50) has a plunger head 640, a plunger rod or stem 642, and a plunger bulb 644. The compression spring 648 is positioned around the stem 642 of the plunger 630, and the plunger-spring is inserted into the barrel 650 (FIGS. 51–53). The compression spring 648 biases the plunger 630 upwards such that the plunger bulb 644 is forced against the elastomeric valve seat 654 (FIG. 53) of the barrel 650 in a sealed closed relation. The button 632 fits snugly over the barrel 650 allowing the two parts to move or rotate together when the button is turned. The barrel 650 fits through an opening 655 in the snap ring 656. The outer flange 658 of the snap ring 656 is stitched to the upper 660 of the shoe 610, as shown in FIG. 44, thereby automatically orienting the valve mechanism 608 and the bladders 602, 604 in the proper location. All components of the valve mechanism 608 below the snap ring 656 are not visible from the outside of the shoe 610 as can be understood from FIG. 44. The shoe 610 can be generally any (preferably high top) athletic shoe adapted to accommodate the present bladder assembly. An example of such a shoe 610 is Nike's AIR COMMAND FORCE shoe and as generally depicted in FIG. 44 with the present bladder assembly assembled therein.

Figure 61:
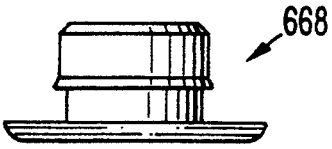
FIG. 61 is an enlarged elevational view of the plug member of the valve mechanism of FIG. 47.
Figure 59:
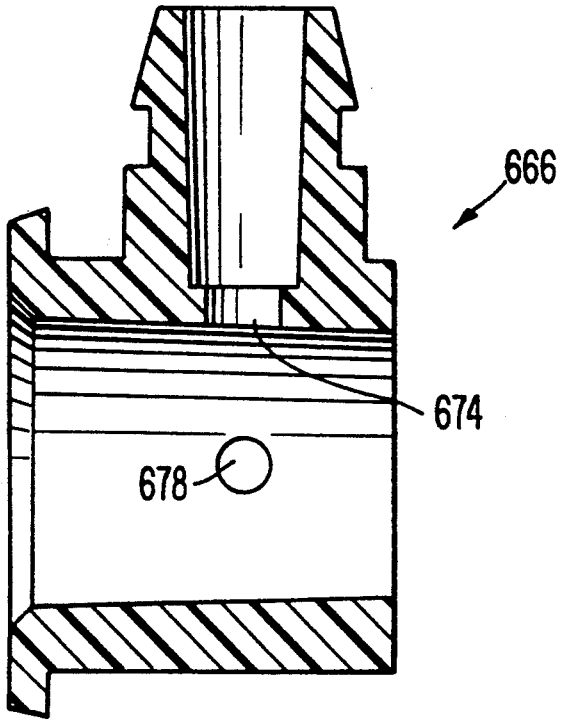
FIG. 59 is a cross-sectional view taken along line 59—59 of FIG. 57.
Figure 60:
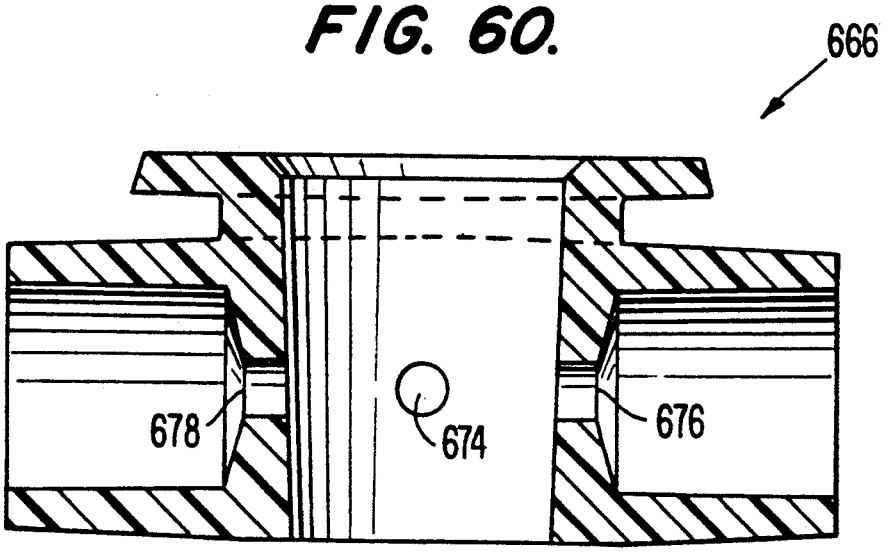
FIG. 60 is a cross-sectional view taken along line 60—60 of FIG. 57.

The snap ring 656 in turn fits over the barrel 650 and inside of the tee member 666 (FIGS. 57–60). The retainer plug 668 (FIG. 61) is fitted into the bottom of the barrel 650 through the base of the tee member 660 thereby locking the entire valve mechanism 608 together. When the button 632 is turned, the barrel 650 is caused to move which in turn realigns the openings 670, 672 (FIG. 53) of the barrel 650 with either openings 674, 676, or 678 (e.g., FIG. 60) in the tee member 666. Opening 674 leads to the articulated pump 606; opening 676 leads to the chamber 604 via channel 634; and opening 678 in turn leads to the chamber 602. Thus, aligning openings 670 and 674, and 672 and 676, which is the button first position, allows chamber 602 to be either inflated by squeezing or depressing the pump 606 or deflated by pushing plunger 630, as desired. Similarly, aligning openings 670 and 674, and 672 and 676, which is the button second position allows chamber 604 to be either inflated or deflated. Turning the button 632 to a neutral (or the third) position therebetween prevents the accidental inflation or deflation of either chamber 602 or 604. When the button 632 is turned the angular movement relative to the tee member 666 is defined by the movement of the arcuate slot 678 (FIG. 52) of the barrel 650 on the nib 679 (FIG. 58) on top of the tee member. Separate polyurethane elastomer weld flanges 680, 682 communicate the tee member 666 with the respective bladders 602, 604. The first communicates directly with the ankle bladder 602, and the second communicates via the passageway 634 with the arch bladder 604. These flanges 680, 682 can be similar to that shown in FIGS. 32 and 33.

It is also within the scope of the present invention to provide for the independent and separate inflation and deflation of more than two bladder chambers within shoe 610. The extra bladder chamber for example might be in the metatarsal area, in the tongue, provide a cushioning layer in the midsole, provide a full sockliner under the foot, a midsole, forefoot or heel chamber, a medial post for pronation control, a lateral crash pad, a cushion directly under the heel, or a cushion under the arch and forefoot. The tee member 666 would be accordingly reconfigured to include more than three passageways to separately and selectively inflate this additional air chamber(s). In lieu of the tee member 666 a manifold having different outlets can be used. Preferred materials for the valve components are nylon 6/6 for the button 632, fifty percent glass-filled nylon (Verton) for the plunger 630, "302" stainless steel with a spring rate of twenty pounds per inch for the compression spring 648, polyurethane elastomer for the barrel 650, polyester elastomer (Shore 60D Hytrel or Ritflex) for the snap ring 656, acetal for the tee member 666 and twenty percent glass-filed acetal for the plug 668.

Figure 62:
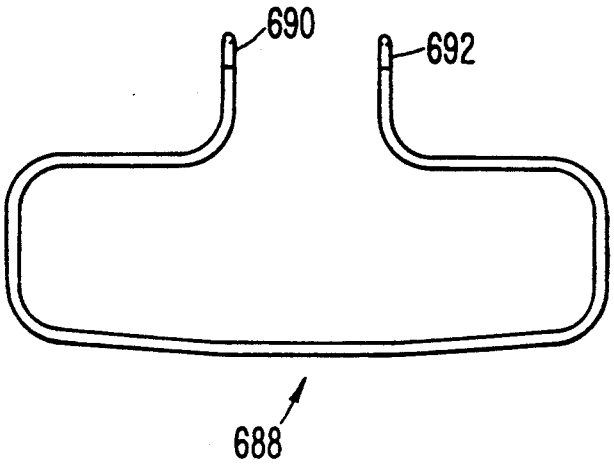
FIG. 62 is a top plan view of the bail of the bladder assembly of FIG. 45 shown in isolation.
Figure 63:
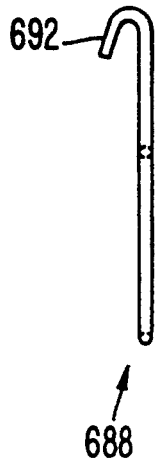
FIG. 63 is a side elevational view of the bail of FIG. 62.
Figure 64:
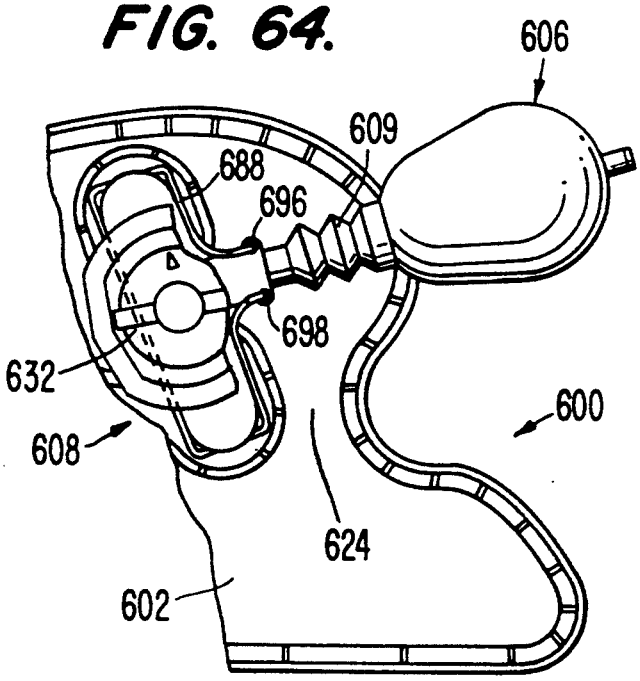
FIG. 64 is a top view of the valve mechanism portion of the bladder assembly of FIG. 45 with portions thereof broken away to illustrate the connection of the bail of FIGS. 62 and 63.
Figure 65:
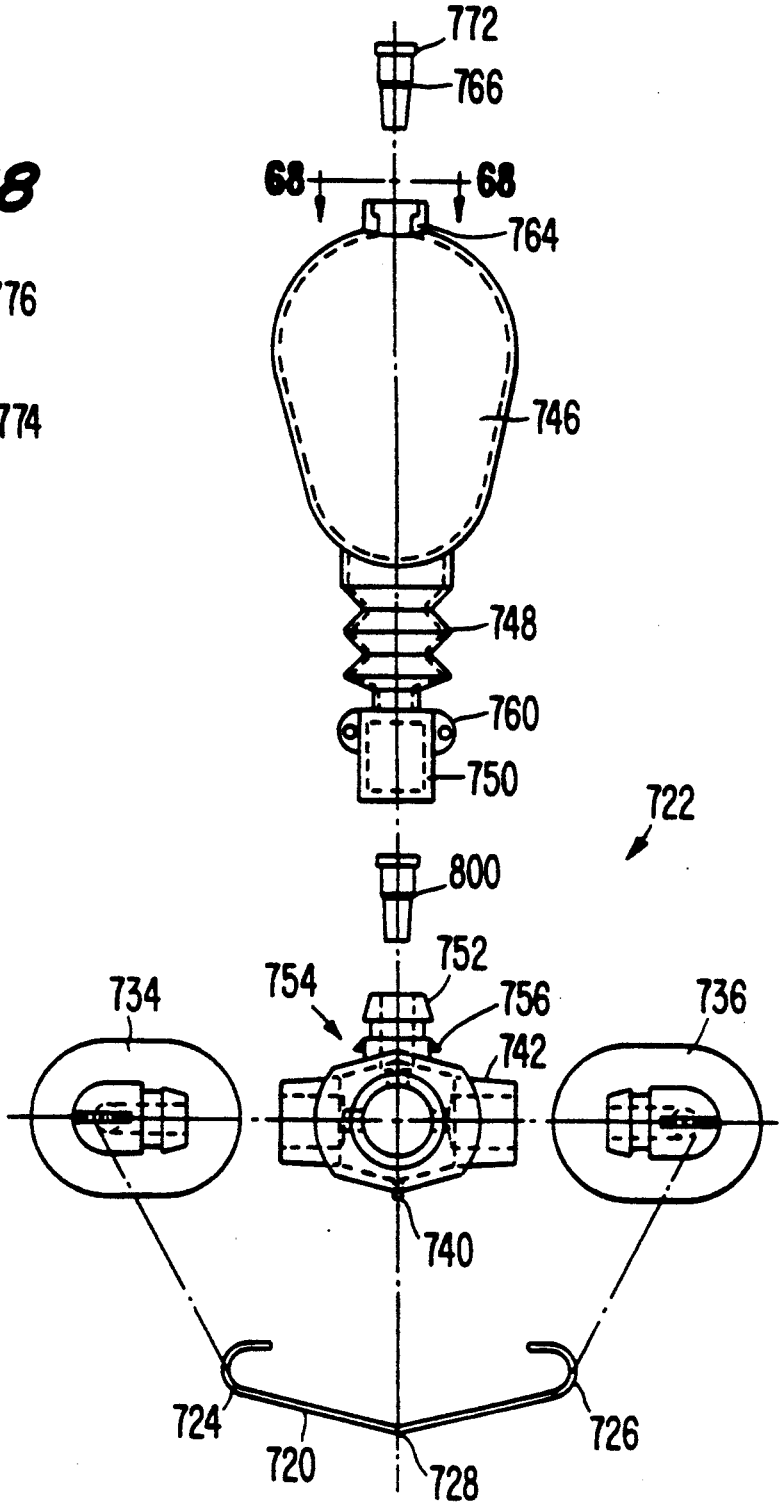
Figure 68:
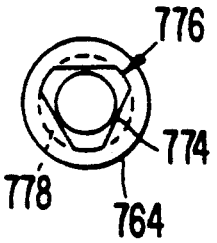
Figure 66:
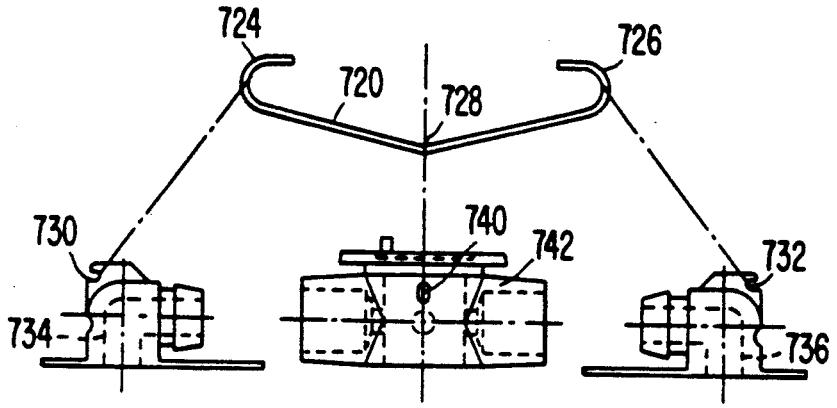
Figure 67:
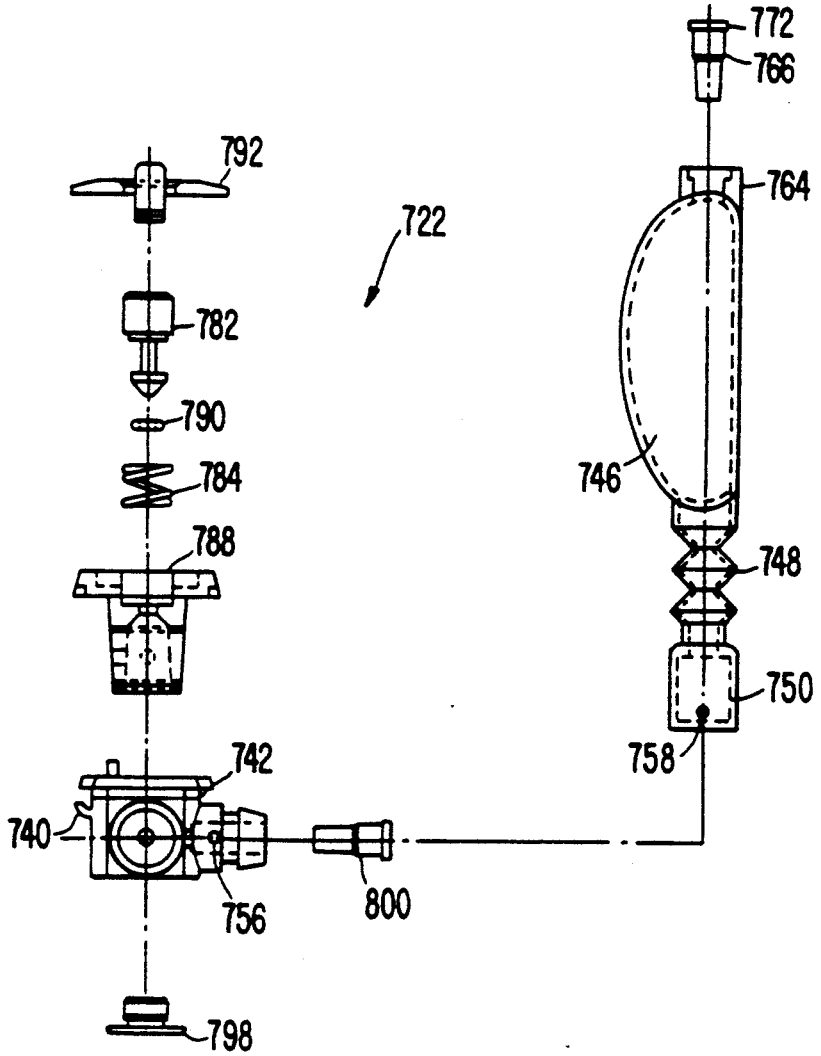
Figure 69:
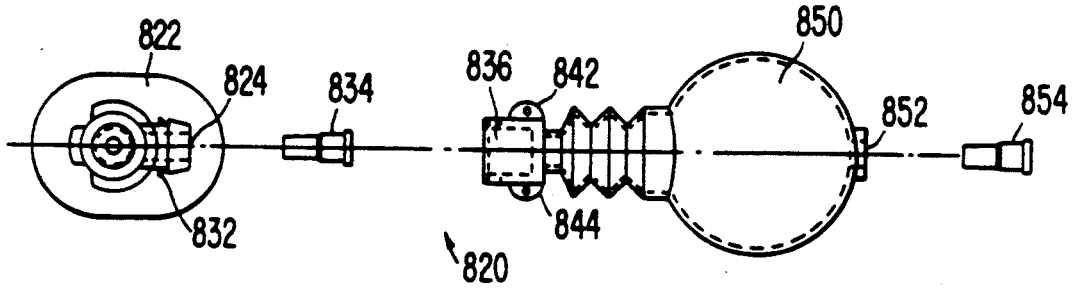
Figure 70:
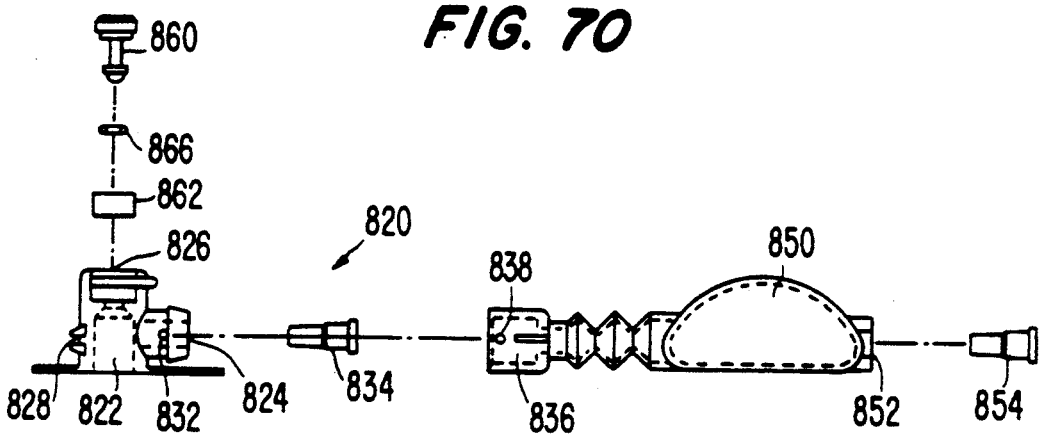
Figure 71:
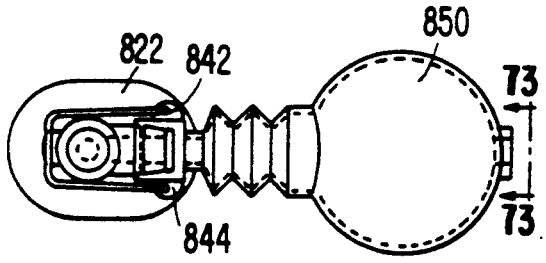
Figure 73:
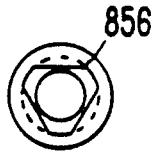
Figure 72:
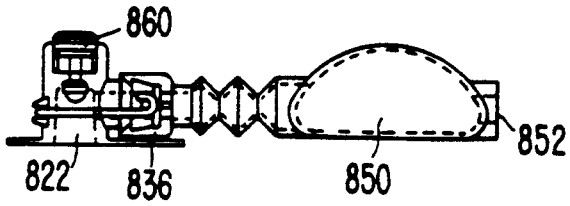
Figure 74:
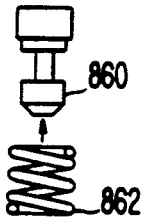
Figure 75:
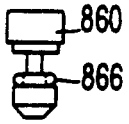
Figure 76:
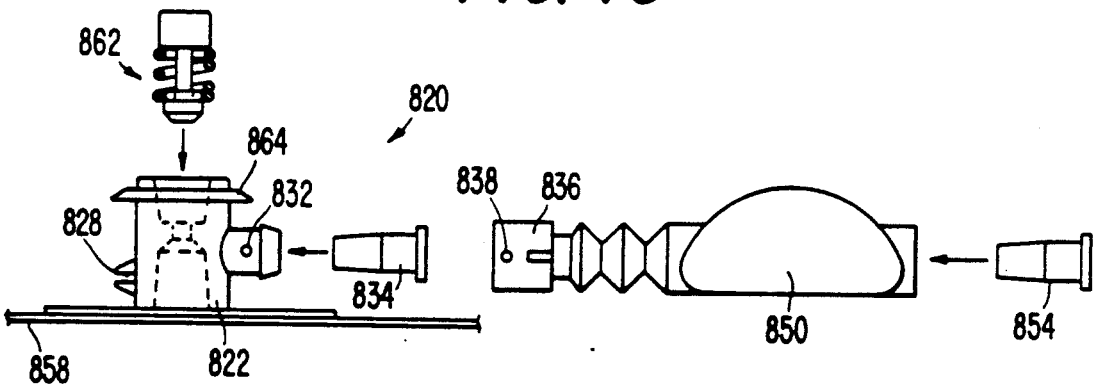
Figure 77:
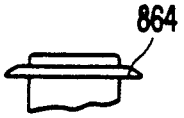

A preferred assembly sequence of the valve mechanism 608 will now be described First, both of the weld flanges 680, 682 are welded to the bladder. The snap ring 656 is stitched by its outer flange 658 in place to the inside of the shoe upper 660. The compression spring 648 is placed over the plunger 630 and then the spring and plunger are pressed into the barrel 650. The barrel 650 is pressed into the tee member 666 from the top thereof, and the plug 668 is pressed into the barrel-tee assembly from the bottom thereof, and the assembly is then snapped onto the two weld flanges 682, 684 on the bladder. The wire bail 688 (FIGS. 62 and 63) is hooked at its ends 690, 692 into the holes 696, 698 on the pump 606 as shown in FIG. 64, similar to the connection of bail 454. A Vernay duckbill valve is attached to the tee member 666 at the opening 674, and the pump 606 is attached to the tee member 666 at the opening over the duckbill valve. The bail 688 is snapped back over the valve mechanism 686 and into the channels on the weld flanges 680, 682, similar to channel 486. The entire assembly is placed in the shoe 610 and pushed through the snap ring 656, and the button 632 is snapped onto the top of the barrel 650. The snap ring 656 thereby automatically locates the bladder assembly properly in the shoe 610. Since the hole in the shoe upper 660 has a rectangular (or hexagonal) type of shape, as opposed to a circular shape, the bladder assembly is also correctly oriented in the shoe 610. Assembly of the bladder assembly is thus easy and generally foolproof. The tab 699 attached to the arch chamber 604 can be optionally used to stitch the bladder assembly to the inner sole of the shoe 610. Thus, when the button 632 is rotated, the barrel 650 and the plug 668 turn with it and a slight rotation of the plunger and the spring results. The snap ring 656 and the tee member 666 are fixed though and do not rotate with the button 632. A liner (similar to liner 380) is positioned and secured inside of the shoe 610 between the foot and the bladders 602, 604 to prevent foot skin or sock from contacting them. The liner can comprise a brushed nylon fabric with a foam backing, and the foam can be a polyurethane, latex or rubber material. All fittings other than the weldings and the stitchings are advantageously friction fit connections, and no adhesives are needed.

Numerous characteristics and advantages of the invention have been described in detail in the foregoing description with reference to the accompanying drawings. However, the disclosure is illustrative only and the invention is not limited to the precise illustrated embodiment. Various changes and modifications may be affected therein by persons skilled in the art without departing from the scope or spirit of the invention. For example, the bladder could be used in a three-quarter height shoe wherein the ankle portion of the upper extends only partially over, or only slightly above, the medial and lateral malleoli.

What is claimed is:

1. A shoe bladder assembly, comprising:

pressure-adjustable first and second bladder chambers positionable in a shoe;

pressure adjusting means for adjusting the pressure in said first and second bladder chambers to adjust the fit of a foot in the shoe with said chambers in position therein;

a passageway assembly including a plurality of passageways in fluid communication with said first and second bladder chambers; and selector means for selecting whether said pressure adjusting means is in operative fluid communication, via said passageways, with alternative said first and second bladder chambers, wherein said selector means comprises a rotational member having a central bore and side openings into said central bore, said side openings providing fluid communication between said central bore and said passageways, and a resiliently-biased release valve in said rotational member and providing fluid communication with said central bore.

2. The shoe bladder assembly of claim 1 wherein said pressure adjustment means is positioned adjacent said first bladder chamber and said passageway assembly includes a passageway communicating with said second chamber that extends at least in part along said first chamber.

3. The assembly of claim 1 wherein said rotational member comprises a barrel operatively associated with said pressure adjusting means, and said side openings comprise barrel lateral openings, and said barrel being repositionable with respect to said passageway assembly to communicate said openings with the corresponding desired said passageways to adjust the pressure in the desired first and second bladder chambers.

4. The shoe bladder assembly of claim 1 wherein said rotational member is a single piece, and said release valve includes a valve seat integrally formed with said rotational member.

5. The shoe bladder assembly of claim 1 further comprising rotation limiting means for limiting the rotation of said rotational member.

6. The shoe bladder assembly of claim 5 wherein said rotation limiting means comprises a slot and nib engagement between said rotational member and a second member attached to said upper.

7. An adjustable fit shoe, comprising:

a shoe upper having an opening;

a ring at said shoe upper opening, secured to said shoe upper and having a ring opening;

a bladder disposed generally within said shoe upper, said bladder including first and second generally separate bladder chambers;

plunger means for controllably deflating said bladder;

a housing assembly in which said plunger means is at least partially disposed;

snap fit means for holding said housing assembly in said ring opening and allowing said housing assembly to rotate relative to said bladder, said housing assembly when in a first position communicates said plunger means with said first chamber and when in a different second rotation position communicates said plunger means with said second chamber; and securing means for securing said housing assembly to said bladder.

8. The shoe of claim 7 wherein said snap fit means includes a rotation button which fit to the top of said housing assembly.

9. The shoe of claim 7 wherein said snap fit means includes a retainer plug which is snap fit to the bottom of said housing assembly.

10. The shoe of claim 7 further comprising bladder inflation pump means for controllably inflating said first chamber with said housing assembly in the first rotation position and said second chamber with said housing assembly in the second rotation position.

11. The shoe of claim 10 wherein said pump means includes a bulb pump held in a pocket on said shoe upper and operable generally from outside of said shoe upper.

12. An adjustable fit shoe comprising:

a sole;

an upper attached to said sole;

pressure-adjustable first and second bladder chambers positioned in the shoe;

pressure adjusting means for adjusting the pressure in said first and second bladder chambers to adjust the fit of a foot in the shoe;

a passageway assembly including a plurality of passageways in fluid communication with said first and second bladder chambers;

selector means for selecting whether said pressure adjusting means is in operative fluid communication, via said passageways, with alternative said first and second bladder chambers;

wherein said selector means includes a barrel operatively associated with said pressure adjusting means, said barrel having barrel lateral openings, and said barrel being repositionable with respect to said passageway assembly to communicate said openings with the corresponding desired said passageways to adjust the pressure in the desired said first and second bladder chambers; and wherein said barrel and said passageway assembly are mounted substantially below an outer wall of said upper such that said barrel and said passageway assembly are substantially obstructed from view from outside of said shoe by said upper and protrude from said upper only a limited extent.

13. The shoe of claim 12 wherein said barrel and said passageway assembly are fixed in said shoe with a retaining mechanism which includes a ring attached to said upper and having a ring opening therethrough, at least a part of at least said selector means extending through said ring opening.

14. The shoe of claim 13 further comprising a button member located outside of said upper which frictionally engages said selector means so as to inhibit removal of said selector means downward below said ring into said shoe.

15. The shoe of claim 14 wherein the frictional engagement of said button member is a snap fit engagement.

16. The shoe of claim 14 further comprising a retainer plug which frictionally engages said selector means on a side opposite than said button member, said retainer plug engaging a surface within said upper so as to inhibit removal of said selector means upward above said ring out of said shoe.

17. The shoe of claim 16 wherein the frictional engagement of said retainer plug is a snap fit engagement.

18. A shoe bladder assembly, comprising:

pressure-adjustable first and second bladder chambers positionable in a shoe;

pressure adjusting means for adjusting the pressure in said first and second bladder chambers to adjust the fit of a foot in the shoe with said chambers in position therein;

a passageway assembly including a plurality of passageways in fluid communication with said first and second bladder chambers; and selector means for selecting whether said pressure adjusting means is in operative fluid communication, via said passageways, with alternative said first and second bladder chambers;

wherein said selector means includes a rotatable barrel operatively associated with said pressure adjusting means, said barrel having barrel lateral openings, and said barrel being rotatable with respect to said passageway assembly to communicate said openings with the corresponding desired said passageways to adjust the pressure in the desired said first and second bladder chambers; and wherein said selector means is adjustable to alternatively define a first barrel position providing communication between said pressure adjusting means and said first chamber, a second intermediate barrel position wherein communication between said pressure adjusting means and both said chambers is blocked, and a third barrel position providing communication between said pressure adjusting means and said second chamber.

19. The shoe bladder assembly of claim 18 wherein said selector means includes a nib and groove assembly between said selector means and said passageway assembly and which guides rotation of said barrel between the first and third positions.

20. The shoe bladder assembly of claim 18 wherein said barrel rotates approximately ninety degrees between the first and third positions.

* * * * *